US008285556B2

(12) United States Patent
Jung et al.

(10) Patent No.: US 8,285,556 B2
(45) Date of Patent: Oct. 9, 2012

(54) APPARATUS AND METHOD FOR ENCODING/DECODING SIGNAL

(75) Inventors: Yang Won Jung, Seoul (KR); Hee Suk Pang, Seoul (KR); Hyen O Oh, Gyeonggi-do (KR); Dong Soo Kim, Seoul (KR); Jae Hyun Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 1028 days.

(21) Appl. No.: 12/278,571

(22) PCT Filed: Feb. 7, 2007

(86) PCT No.: PCT/KR2007/000668

§ 371 (c)(1),
(2), (4) Date: Aug. 6, 2008

(87) PCT Pub. No.: WO2007/091842

PCT Pub. Date: Aug. 16, 2007

(65) Prior Publication Data

US 2009/0037189 A1 Feb. 5, 2009

Related U.S. Application Data

(60) Provisional application No. 60/793,653, filed on Apr. 21, 2006, provisional application No. 60/792,329, filed on Apr. 17, 2006, provisional application No. 60/782,519, filed on Mar. 16, 2006, provisional application No. 60/781,750, filed on Mar. 14, 2006, provisional application No. 60/775,775, filed on Feb. 23, 2006, provisional application No. 60/773,337, filed on Feb. 15, 2006, provisional application No. 60/771,471, filed on Feb. 9, 2006, provisional application No. 60/765,747, filed on Feb. 7, 2006.

(51) Int. Cl.
*G10L 19/00* (2006.01)

(52) U.S. Cl. ..... 704/500; 704/501; 704/504; 704/229; 381/17; 381/309

(58) Field of Classification Search ..... 704/500, 704/501, 504, 229; 381/17, 309
See application file for complete search history.

(56) References Cited

U.S. PATENT DOCUMENTS 5,166,685 A 11/1992 Campbell et al.

(Continued)

FOREIGN PATENT DOCUMENTS

CN 1253464 5/2000

(Continued)

OTHER PUBLICATIONS

Herre et al. "The Reference Model Architecture for MPEG Spatial Audio Coding" Audio Engineering Society Convention Paper, May 28-31, 2005.*

(Continued)

*Primary Examiner* — Vincent P Harper
(74) *Attorney, Agent, or Firm* — Fish & Richardson P.C.

(57) ABSTRACT

An encoding method and apparatus and a decoding method and apparatus are provided. The decoding method includes extracting a three-dimensional (3D) down-mix signal and spatial information from an input bitstream, removing 3D effects from the 3D down-mix signal by performing a 3D rendering operation on the 3D down-mix signal, and generating a multi-channel signal using the spatial information and a down-mix signal obtained by the removal. Accordingly, it is possible to efficiently encode multi-channel signals with 3D effects and to adaptively restore and reproduce audio signals with optimum sound quality according to the characteristics of a reproduction environment.

13 Claims, 8 Drawing Sheets

U.S. PATENT DOCUMENTS

| | | | |
|---|---|---|---|
| 5,524,054 | A | 6/1996 | Spille |
| 5,561,736 | A | 10/1996 | Moore et al. |
| 5,579,396 | A | 11/1996 | Iida et al. |
| 5,632,005 | A | 5/1997 | Davis et al. |
| 5,668,924 | A | 9/1997 | Takahashi |
| 5,703,584 | A | 12/1997 | Hill |
| 5,862,227 | A | 1/1999 | Orduna-Bustamante et al. |
| 6,072,877 | A | 6/2000 | Abel |
| 6,081,783 | A | 6/2000 | Divine et al. |
| 6,118,875 | A | 9/2000 | Moller |
| 6,226,616 | B1 | 5/2001 | You et al. |
| 6,307,941 | B1 | 10/2001 | Tanner, Jr. et al. |
| 6,466,913 | B1 | 10/2002 | Yasuda et al. |
| 6,504,496 | B1 | 1/2003 | Mesarovic et al. |
| 6,574,339 | B1 | 6/2003 | Kim |
| 6,611,212 | B1 | 8/2003 | Craven et al. |
| 6,711,266 | B1 | 3/2004 | Aylward et al. |
| 6,721,425 | B1 | 4/2004 | Aylward |
| 6,795,556 | B1 | 9/2004 | Sibbald et al. |
| 6,973,130 | B1 | 12/2005 | Wee et al. |
| 7,085,393 | B1 | 8/2006 | Chen |
| 7,180,964 | B2 | 2/2007 | Borowski et al. |
| 7,260,540 | B2 | 8/2007 | Miyasaka et al. |
| 7,519,530 | B2 | 4/2009 | Kaajas et al. |
| 7,519,538 | B2 | 4/2009 | Villemoes et al. |
| 7,555,434 | B2 | 6/2009 | Nomura et al. |
| 7,613,306 | B2 | 11/2009 | Miyasaka et al. |
| 7,720,230 | B2 | 5/2010 | Allamanche et al. |
| 7,761,304 | B2 | 7/2010 | Faller |
| 7,773,756 | B2 | 8/2010 | Beard |
| 7,787,631 | B2 | 8/2010 | Faller |
| 7,880,748 | B1 | 2/2011 | Sevigny |
| 7,916,873 | B2 | 3/2011 | Villemoes et al. |
| 7,961,889 | B2 | 6/2011 | Kim et al. |
| 7,979,282 | B2 | 7/2011 | Kim et al. |
| 7,987,096 | B2 | 7/2011 | Kim et al. |
| 8,081,762 | B2 | 12/2011 | Ojala et al. |
| 8,081,764 | B2 | 12/2011 | Takagi et al. |
| 8,116,459 | B2 | 2/2012 | Disch et al. |
| 8,150,042 | B2 | 4/2012 | Van Loon et al. |
| 8,189,682 | B2 | 5/2012 | Yamasaki |
| 2003/0007648 | A1 | 1/2003 | Currell |
| 2003/0035553 | A1 | 2/2003 | Baumgarte et al. |
| 2003/0182423 | A1 | 9/2003 | Shafir et al. |
| 2003/0236583 | A1 | 12/2003 | Baumgarte et al. |
| 2004/0032960 | A1 | 2/2004 | Griesinger |
| 2004/0049379 | A1 | 3/2004 | Thumpudi et al. |
| 2004/0071445 | A1 | 4/2004 | Tarnoff et al. |
| 2004/0111171 | A1 | 6/2004 | Jang et al. |
| 2004/0118195 | A1 | 6/2004 | Nespo et al. |
| 2004/0138874 | A1 | 7/2004 | Kaajas et al. |
| 2004/0196770 | A1 | 10/2004 | Touyama et al. |
| 2004/0196982 | A1 | 10/2004 | Aylward et al. |
| 2005/0061808 | A1 | 3/2005 | Cole et al. |
| 2005/0063613 | A1 | 3/2005 | Casey et al. |
| 2005/0074127 | A1 | 4/2005 | Herre et al. |
| 2005/0089181 | A1 | 4/2005 | Polk, Jr. |
| 2005/0117762 | A1 | 6/2005 | Sakurai et al. |
| 2005/0135643 | A1 | 6/2005 | Lee et al. |
| 2005/0157883 | A1 | 7/2005 | Herre et al. |
| 2005/0179701 | A1 | 8/2005 | Jahnke |
| 2005/0180579 | A1 | 8/2005 | Baumgarte |
| 2005/0195981 | A1 | 9/2005 | Faller et al. |
| 2005/0271367 | A1 | 12/2005 | Lee et al. |
| 2005/0273322 | A1 | 12/2005 | Lee et al. |
| 2005/0273324 | A1 | 12/2005 | Yi |
| 2006/0002572 | A1 | 1/2006 | Smithers et al. |
| 2006/0004583 | A1 | 1/2006 | Herre et al. |
| 2006/0008091 | A1 | 1/2006 | Kim et al. |
| 2006/0009225 | A1 | 1/2006 | Herre et al. |
| 2006/0050909 | A1 | 3/2006 | Kim et al. |
| 2006/0072764 | A1 | 4/2006 | Mertens et al. |
| 2006/0083394 | A1 | 4/2006 | McGrath |
| 2006/0115100 | A1 | 6/2006 | Faller et al. |
| 2006/0133618 | A1 | 6/2006 | Villemoes et al. |
| 2006/0153408 | A1 | 7/2006 | Faller et al. |
| 2006/0190247 | A1 | 8/2006 | Lindblom |
| 2006/0233379 | A1 | 10/2006 | Villemoes et al. |
| 2006/0239473 | A1 | 10/2006 | Kjorling et al. |
| 2006/0251276 | A1 | 11/2006 | Chen |
| 2007/0160218 | A1 | 7/2007 | Jakka et al. |
| 2007/0160219 | A1 | 7/2007 | Jakka et al. |
| 2007/0162278 | A1 | 7/2007 | Miyasaka et al. |
| 2007/0183603 | A1 | 8/2007 | Jin et al. |
| 2007/0203697 | A1 | 8/2007 | Pang et al. |
| 2007/0219808 | A1 | 9/2007 | Herre et al. |
| 2007/0223709 | A1 | 9/2007 | Kim et al. |
| 2007/0233296 | A1 | 10/2007 | Kim et al. |
| 2007/0258607 | A1 | 11/2007 | Purnhagen et al. |
| 2007/0280485 | A1 | 12/2007 | Villemoes |
| 2007/0291950 | A1 | 12/2007 | Kimura et al. |
| 2008/0002842 | A1 | 1/2008 | Neusinger et al. |
| 2008/0008327 | A1 | 1/2008 | Ojala et al. |
| 2008/0033732 | A1 | 2/2008 | Seefeldt et al. |
| 2008/0052089 | A1 | 2/2008 | Takagi |
| 2008/0130904 | A1 | 6/2008 | Faller |
| 2008/0195397 | A1 | 8/2008 | Myburg et al. |
| 2008/0304670 | A1 | 12/2008 | Breebaart |
| 2009/0110203 | A1 | 4/2009 | Taleb |
| 2009/0129601 | A1 | 5/2009 | Ojala et al. |

FOREIGN PATENT DOCUMENTS

| | | | |
|---|---|---|---|
| CN | 1495705 | | 5/2004 |
| EP | 0 637 191 | | 2/1995 |
| EP | 0857375 | | 8/1998 |
| EP | 1 315 148 | | 5/2003 |
| EP | 1376538 | A1 | 1/2004 |
| EP | 1455345 | | 9/2004 |
| EP | 1 545 154 | | 6/2005 |
| EP | 1 617 413 | | 1/2006 |
| JP | 7248255 | | 9/1995 |
| JP | 08-079900 | | 3/1996 |
| JP | 8-084400 | | 3/1996 |
| JP | 9-074446 | | 3/1997 |
| JP | 09-224300 | | 8/1997 |
| JP | 9-261351 | | 10/1997 |
| JP | 09-275544 | | 10/1997 |
| JP | 10-304498 | | 11/1998 |
| JP | 11-032400 | | 2/1999 |
| JP | 11503882 | | 3/1999 |
| JP | 2001028800 | | 1/2001 |
| JP | 2001-188578 | | 7/2001 |
| JP | 2001-516537 | | 9/2001 |
| JP | 2001-359197 | | 12/2001 |
| JP | 2002-049399 | | 2/2002 |
| JP | 2003-009296 | | 1/2003 |
| JP | 2003-111198 | | 4/2003 |
| JP | 2004-078183 | | 3/2004 |
| JP | 2004-535145 | | 11/2004 |
| JP | 2005-063097 | | 3/2005 |
| JP | 2005-229612 | | 8/2005 |
| JP | 2005-523624 | | 8/2005 |
| JP | 2005-352396 | | 12/2005 |
| JP | 2006-014219 | | 1/2006 |
| JP | 2007-511140 | | 4/2007 |
| JP | 2007-288900 | | 11/2007 |
| JP | 2008-504578 | | 2/2008 |
| JP | 08-065169 | | 3/2008 |
| JP | 2008-511044 | | 4/2008 |
| JP | 08-202397 | | 9/2008 |
| KR | 10-2001-000993 | | 1/2001 |
| KR | 10-2001-0009258 | | 2/2001 |
| KR | 2004106321 | A | 12/2004 |
| KR | 2005061808 | A | 6/2005 |
| KR | 2005063613 | A | 6/2005 |
| RU | 2119259 | | 9/1998 |
| RU | 2129336 | | 4/1999 |
| RU | 2221329 | C2 | 1/2004 |
| RU | 2004133032 | | 4/2005 |
| RU | 2005103637 | A | 7/2005 |
| RU | 2005104123 | | 7/2005 |
| TW | 263646 | | 11/1995 |
| TW | 289885 | | 11/1996 |
| TW | 503626 | | 9/2001 |
| TW | 468182 | | 12/2001 |
| TW | 550541 | | 9/2003 |
| TW | 200304120 | | 9/2003 |

| | | | |
|---|---|---|---|
| TW | 200405673 | | 4/2004 |
| TW | 594675 | | 6/2004 |
| TW | I230024 | | 3/2005 |
| TW | 200921644 | | 5/2005 |
| TW | 2005334234 | | 10/2005 |
| TW | 200537436 | A | 11/2005 |
| WO | 97/15983 | | 5/1997 |
| WO | WO 98/42162 | | 9/1998 |
| WO | 99/49574 | | 9/1999 |
| WO | 9949574 | | 9/1999 |
| WO | WO 03/007656 | | 1/2003 |
| WO | WO 03-007656 | | 1/2003 |
| WO | 03/085643 | | 10/2003 |
| WO | 03-090208 | | 10/2003 |
| WO | 2004-008805 | | 1/2004 |
| WO | 2004/008806 | | 1/2004 |
| WO | 2004-019656 | | 3/2004 |
| WO | 2004/028204 | | 4/2004 |
| WO | 2004-036549 | | 4/2004 |
| WO | 2004-036954 | | 4/2004 |
| WO | 2004-036955 | | 4/2004 |
| WO | 2004036548 | | 4/2004 |
| WO | 2005/036925 | | 4/2005 |
| WO | 2005/043511 | | 5/2005 |
| WO | 2005/069637 | | 7/2005 |
| WO | 2005/069638 | | 7/2005 |
| WO | 2005/081229 | | 9/2005 |
| WO | 2005/098826 | | 10/2005 |
| WO | 2005/101371 | | 10/2005 |
| WO | WO2005101370 | A1 | 10/2005 |
| WO | 2006/002748 | | 1/2006 |
| WO | WO 2006-003813 | | 1/2006 |
| WO | 2007/080212 | | 7/2007 |

OTHER PUBLICATIONS

Search Report, European Appln. No. 07708824.3, dated Dec. 15, 2010, 7 pages.
Faller, C. et al., "Efficient Representation of Spatial Audio Using Perceptual Parametrization," Workshop on Applications of Signal Processing to Audio and Acoustics, Oct. 21-24, 2001, Piscataway, NJ, USA, IEEE, pp. 199-202.
Office Action, Japanese Appln. No. 2008-551195, dated Dec. 21, 2010, 10 pages with English translation.
Korean Office Action for Appln. No. 10-2008-7016477 dated Mar. 26, 2010, 4 pages.
Hironori Tokuno. Et al. "Inverse Filter of Sound Reproduction Systems Using Regularization", IEICE Trans. Fundamentals. vol. E80-A.No. 5.May 1997, pp. 809-820.
Korean Office Action for Appln. No. 10-2008-7016478 dated Mar. 26, 2010, 4 pages.
Korean Office Action for Appln. No. 10-2008-7016479 dated Mar. 26, 2010, 4 pages.
Taiwanese Office Action for Appln. No. 096102406 dated Mar. 4, 2010, 7 pages.
Breebaart et al., "MPEG Surround Binaural Coding Proposal Philips/CT/ThG/VAST Audio," ITU Study Group 16—Video Coding Experts Group—ISO/IEC MPEG & ITU-T VCEG (ISO/IEC JTC1/SC29/WG11 and ITU-T SG16 Q6), XX, XX, No. M13253, Mar. 29, 2006, 49 pages.
Office Action, U.S. Appl. No. 11/915,327, dated Apr. 8, 2011, 14 pages.
Search Report, European Appln. No. 07701033.8, dated Apr. 1, 2011, 7 pages.
Kjörling et al., "MPEG Surround Amendment Work Item on Complexity Reductions of Binaural Filtering," ITU Study Group 16 Video Coding Experts Group—ISO/IEC MPEG & ITU-T VCEG (ISO/IEC JTC1/SC29/WG11 and ITU-T SG16 Q6), XX, XX, No. M13672, Jul. 12, 2006, 5 pages.
Kok Seng et al., "Core Experiment on Adding 3D Stereo Support to MPEG Surround," ITU Study Group 16 Video Coding Experts Group—ISO/IEC MPEG & ITU-T VCEG (ISO/IEC JTC1/SC29/WG11 and ITU-T SG16 Q6), XX, XX, No. M12845, Jan. 11, 2006, 11 pages.
"Text of ISO/IEC 14496-3:200X/PDAM 4, MPEG Surround," ITU Study Group 16 Video Coding Experts Group—ISO/IEC MPEG & ITU-T VCEG (ISO/IEC JTC1/SC29/WG11 and ITU-T SG16 Q6), XX, XX, No. N7530, Oct. 21, 2005, 169 pages.
Office Action, Japanese Appln. No. 2008-513374, mailed Aug. 24, 2010, 8 pages with English translation.
Faller, "Coding of Spatial Audio Compatible with Different Playback Formats," Proceedings of the Audio Engineering Society Convention Paper, USA, Audio Engineering Society, Oct. 28, 2004, 117th Convention, pp. 1-12.
Schuijers et al., "Advances in Parametric Coding for High-Quality Audio," Proceedings of the Audio Engineering Society Convention Paper 5852, Audio Engineering Society, Mar. 22, 2003, 114th Convention, pp. 1-11.
Office Action, Canadian Application No. 2,636,494, mailed Aug. 4, 2010, 3 pages.
Chinese Gazette, Chinese Appln. No. 200680018245.0, dated Jul. 27, 2011, 3 pages with English abstract.
Notice of Allowance, Japanese Appln. No. 2008-551193, dated Jul. 20, 2011, 6 pages with English translation.
U.S. Appl. No. 11/915,329, mailed Oct. 8, 2010, 13 pages.
Moon et al., "A Multichannel Audio Compression Method with Virtual Source Location Information for MPEG-4 SAC," IEEE Trans. Consum. Electron., vol. 51, No. 4, Nov. 2005, pp. 1253-1259.
Chinese Office Action issued in Appln No. 200780004505.3 on Mar. 2, 2011, 14 pages, including English translation.
European Search Report for Application No. 07 708 820.1 dated Apr. 9, 2010, 8 pages.
European Search Report for Application No. 07 708 818.5 dated Apr. 15, 2010, 7 pages.
Kulkarni et al., "On the Minimum-Phase Approximation of Head-Related Transfer Functions," Applications of Signal Processing to Audio and Acoustics, IEEE ASSP Workshop on New Paltz, Oct. 15-18, 1995, 4 pages.
"ISO/IEC 23003-1:2006/FCD, MPEG Surround," ITU Study Group 16, Video Coding Experts Group—ISO/IEC MPEG & ITU-T VCEG (ISO/IEC/JTC1/SC29/WG11 and ITU-T SG16 Q6), XX, XX, No. N7947, Mar. 3, 2006, 186 pages.
Search Report, European Appln. No. 07701037.9, dated Jun. 15, 2011, 8 pages.
International Search Report for PCT Application No. PCT/KR2007/000342, dated Apr. 20, 2007, 3 pages.
Office Action, U.S. Appl. No. 11/915,327, dated Dec. 10, 2010, 20 pages.
Japanese Office Action dated Nov. 9, 2010 from Japanese Application No. 2008-551199 with English translation, 11 pages.
Japanese Office Action dated Nov. 9, 2010 from Japanese Application No. 2008-551194 with English translation, 11 pages.
Japanese Office Action dated Nov. 9, 2010 from Japanese Application No. 2008- 551193 with English translation, 11 pages.
Japanese Office Action dated Nov. 9, 2010 from Japanese Application No. 2008- 551200 with English translation, 11 pages.
Korean Office Action dated Nov. 25, 2010 from Korean Application No. 10-2008-7016481 with English translation, 8 pages.
MPEG-2 Standard. ISO/IEC Document 13818-3:1994(E), Generic Coding of Moving Pictures and Associated Audio information, Part 3: Audio, Nov. 11, 1994, 4 pages.
Office Action, Japanese Appln. No. 2008-551196, dated Dec. 21, 2010, 4 pages with English translation.
Russian Notice of Allowance for Application No. 2008133995 dated Feb. 11, 2010, 11 pages.
Final Office Action, U.S. Appl. No. 11/915,329, dated Mar. 24, 2011, 14 pages.
Korean Office Action for KR Application No. 10-2008-7016477, dated Mar. 26, 2010, 12 pages.
Korean Office Action for KR Application No. 10-2008-7016479, dated Mar. 26, 2010, 11 pages.
Taiwanese Office Action for TW Application No. 96104543, dated Mar. 30, 2010, 12, pages.
European Search Report, EP Application No. 07 708 825.0, mailed May 26, 2010, 8 pages.
Schroeder, E. F. et al., "Der MPEG-2-Standard: Generische Codierung für Bewegtbilder und zugehörige Audio-Information, Audio-Codierung (Teil 4)," Fkt Fernseh Und Kinotechnik, Fachverlag Schiele & Schon Gmbh., Berlin, DE, vol. 47, No. 7-8, Aug. 30, 1994, pp. 364-368 and 370.
Japanese Office Action for Application No. 2008-513378, dated Dec. 14, 2009, 12 pages.
Taiwan Examiner, Taiwanese Office Action for Application No. 096102407, dated Dec. 10, 2009, 8 pages.
Taiwan Patent Office, Office Action in Taiwanese patent application 096102410, dated Jul. 2, 2009, 5 pages.
Chinese Patent Gazette, Chinese Appln. No. 200780001540.X, mailed Jun. 15, 2011, 2 pages with English abstract.
Engdegärd et al. "Synthetic Ambience in Parametric Stereo Coding," Audio Engineering Society (AES) 116th Convention, Berlin, Germany, May 8-11, 2004, pp. 1-12.
Search Report, European Appln. No. 07708534.8, dated Jul. 4, 2011, 7 pages.
Russian Notice of Allowance for Application No. 2008114388, dated Aug. 24, 2009, 13 pages.
Taiwan Examiner, Taiwanese Office Action for Application No. 96104544, dated Oct. 9, 2009, 13 pages.
Notice of Allowance (English language translation) from RU 2008136007 dated Jun. 8, 2010, 5 pages.
U.S. Office Action dated Mar. 15, 2012 for U.S. Appl. No. 12/161,558, 4 pages.
U.S. Office Action dated Mar. 30, 2012 for U.S. Appl. No. 11/915,319, 12 pages.
European Office Action dated Apr. 2, 2012 for Application No. 06 747 458.5, 4 pages.
Beack S; et al.; "An Efficient Representation Method for ICLD with Robustness to Spectral Distortion", IETRI Journal, vol. 27, No. 3, Jun. 2005, Electronics and Telecommunications Research Institute, KR, Jun. 1, 2005, XP003008889, 4 pages.
Office Action, U.S. Appl. No. 12/161,563, dated Jan. 18, 2012, 39 pages.
Office Action, U.S. Appl. No. 12/161,337, dated Jan. 9, 2012, 4 pages.
Office Action, U.S. Appl. No. 12/278,774, dated Jan. 20, 2012, 44 pages.
"Text of ISO/IEC 23003-1:2006/FCD, MPEG Surround," International Organization for Standardization Organisation Internationale De Normalisation, ISO/IEC JTC 1/SC 29/WG 11 Coding of Moving Pictures and Audio, No. N7947, Audio sub-group, Jan. 2006, Bangkok, Thailand, pp. 1-178.
Pasi, Ojala, "New use cases for spatial audio coding," ITU Study Group 16—Video Coding Experts Group—ISO/IEG MPEG & ITU-T VCEG (ISO/IEC JTC1/SC29/WG11 and ITU-T SG16 Q6), XX, XX, No. M12913; XP030041582 (Jan. 11, 2006).
Pasi, Ojala et al., "Further information on 1-26 Nokia binaural decoder," ITU Study Group 16—Video Coding Experts Group—ISO/IEC MPEG & ITU-T VCEG (ISO/IEC JTC1/SC29/WG11 and ITU-T SG16 Q6), XX, XX, No. M13231; XP030041900 (Mar. 29, 2006).
Kristofer, Kjorling, "Proposal for extended signaling in spatial audio," ITU Study Group 16—Video Coding Experts Group—ISO/IEC MPEG & ITU-T VCEG (ISO/IEC JTC1/SC29/WG11 and ITU-T SG16 Q6), XX, XX, No. M12361; XP030041045 (Jul. 20, 2005).
WD 2 for MPEG Surround, ITU Study Group 16—Video Coding Experts Group—ISO/IEC MPEG & ITU-T VCEG (ISO/IEC JTC1/SC29/WG11 and ITU-T SG16 Q6), XX, XX, No. N7387; XP030013965 (Jul. 29, 2005).
EPO Examiner, European Search Report for Application No. 06 747 458.5 dated Feb. 4, 2011.
EPO Examiner, European Search Report for Application No. 06 747 459.3 dated Feb. 4, 2011.
Breebaart, et al.: "Multi-Channel Goes Mobile: MPEG Surround Binaural Rendering" In: Audio Engineering Society the 29th International Conference, Seoul, Sep. 2-4, 2006, pp. 1-13. See the abstract, pp. 1-4, figures 5,6.
Breebaart, J., et al.: "MPEG Spatial Audio Coding/MPEG Surround: Overview and Current Status" In: Audio Engineering Society the 119th Convention, New York, Oct. 7-10, 2005, pp. 1-17. See pp. 4-6.
Faller, C., et al.: "Binaural Cue Coding-Part II: Schemes and Applications", IEEE Transactions on Speech and Audio Processing, vol. 11, No. 6, 2003, 12 pages.
Faller, C.: "Coding of Spatial Audio Compatible with Different Playback Formats", Audio Engineering Society Convention Paper, Presented at 117th Convention, Oct. 28-31, 2004, San Francisco, CA.
Faller, C.: "Parametric Coding of Spatial Audio", Proc. of the 7th Int. Conference on Digital Audio Effects, Naples, Italy, 2004, 6 pages.
Herre, J., et al.: "Spatial Audio Coding: Next generation efficient and compatible coding of multi-channel audio", Audio Engineering Society Convention Paper, San Francisco, CA , 2004, 13 pages.
Herre, J., et al.: "The Reference Model Architecture for MPEG Spatial Audio Coding", Audio Engineering Society Convention Paper 6447, 2005, Barcelona, Spain, 13 pages.
International Search Report in International Application No. PCT/KR2006/000345, dated Apr. 19, 2007, 1 page.
International Search Report in International Application No. PCT/KR2006/000346, dated Apr. 18, 2007, 1 page.
International Search Report in International Application No. PCT/KR2006/000347, dated Apr. 17, 2007, 1 page.
International Search Report in International Application No. PCT/KR2006/000866, dated Apr. 30, 2007, 1 page.
International Search Report in International Application No. PCT/KR2006/000867, dated Apr. 30, 2007, 1 page.
International Search Report in International Application No. PCT/KR2006/000868, dated Apr. 30, 2007, 1 page.
International Search Report in International Application No. PCT/KR2006/001987, dated Nov. 24, 2006, 2 pages.
International Search Report in International Application No. PCT/KR2006/002016, dated Oct. 16, 2006, 2 pages.
International Search Report in International Application No. PCT/KR2006/003659, dated Jan. 9, 2007, 1 page.
International Search Report in International Application No. PCT/KR2006/003661, dated Jan. 11, 2007, 1 page.
International Search Report in International Application No. PCT/KR2007/000340, dated May 4, 2007, 1 page.
International Search Report in International Application No. PCT/KR2007/000668, dated Jun. 11, 2007, 2 pages.
International Search Report in International Application No. PCT/KR2007/000672, dated Jun. 11, 2007, 1 page.
International Search Report in International Application No. PCT/KR2007/000675, dated Jun. 8, 2007, 1 page.
International Search Report in International Application No. PCT/KR2007/000676, dated Jun. 8, 2007, 1 page.
International Search Report in International Application No. PCT/KR2007/000730, dated Jun. 12, 2007, 1 page.
International Search Report in International Application No. PCT/KR2007/001560, dated Jul. 20, 2007, 1 page.
International Search Report in International Application No. PCT/KR2007/001602, dated Jul. 23, 2007, 1 page.
Scheirer, E. D., et al.: "AudioBIFS: Describing Audio Scenes with the MPEG-4 Multimedia Standard", IEEE Transactions on Multimedia, Sep. 1999, vol. 1, No. 3, pp. 237-250. See the abstract.
Vannanen, R., et al.: "Encoding and Rendering of Perceptual Sound Scenes in the Carrouso Project", AES 22nd International Conference on Virtual, Synthetic and Entertainment Audio, Paris, France, 9 pages, Jun. 2002.
Vannanen, Riitta, "User Interaction and Authoring of 3D Sound Scenes in the Carrouso EU project", Audio Engineering Society Convention Paper 5764, Amsterdam, The Netherlands, 2003, 9 pages.
Office Action, U.S. Appl. No. 12/161,560, dated Feb. 17, 2012, 13 pages.
Savioja, "Modeling Techniques for Virtual Acoustics," Thesis, Aug. 24, 2000, 88 pages.
Chang, "Document Register for 75th meeting in Bangkok, Thailand", ISO/IEC JTC/SC29/WG11, MPEG2005/M12715, Bangkok, Thailand, Jan. 2006, 3 pages.
Donnelly et al., "The Fast Fourier Transform for Experimentalists, Part II: Convolutions," Computing in Science & Engineering, IEEE, Aug. 1, 2005, vol. 7, No. 4, pp. 92-95.
Office Action, U.S. Appl. No. 12/161,560, dated Oct. 27, 2011, 14 pages.

Office Action, U.S. Appl. No. 12/278,775, dated Dec. 9, 2011, 16 pages.
Office Action, European Appln. No. 07 701 033.8, dated Dec. 16, 2011, 4 pages.
Office Action, U.S. Appl. No. 12/278,569, dated Dec. 2, 2011, 10 pages.
Notice of Allowance, U.S. Appl. No. 12/278,572, dated Dec. 20, 2011, 12 pages.
Notice of Allowance, U.S. Appl. No. 12/161,334, dated Dec. 20, 2011, 11 pages.
Herre et al., "MP3 Surround: Efficient and Compatible Coding of Multi-Channel Audio," Convention Paper of the Audio Engineering Society 116th Convention, Berlin, Germany, May 8, 2004, 6049, pp. 1-14.
Office Action, Japanese Appln. No. 2008-554134, dated Nov. 15, 2011, 6 pages with English translation.
Office Action, Japanese Appln. No. 2008-554141, dated Nov. 24, 2011, 8 pages with English translation.
Office Action, Japanese Appln. No. 2008-554139, dated Nov. 16, 2011, 12 pages with English translation.
Office Action, Japanese Appln. No. 2008-554138, dated Nov. 22, 2011, 7 pages with English translation.
Quackenbush, "Annex I-Audio report" ISO/IEC JTC1/SC29/WG11, MPEG, N7757, Moving Picture Experts Group, Bangkok, Thailand, Jan. 2006, pp. 168-196.
"Text of ISO/IEC 14496-3:2001/FPDAM 4, Audio Lossless Coding (ALS), New Audio Profiles and BSAC Extensions," International Organization for Standardization, ISO/IEC JTC1/SC29/WG11, No. N7016, Hong Kong, China, Jan. 2005, 65 pages.
Office Action, U.S. Appl. No. 12/161,563, dated Apr. 16, 2012, 11 pages.
Office Action, U.S. Appl. No. 12/278,775, dated Jun. 11, 2012, 13 pages.
Office Action, U.S. Appl. No. 12/278,774, dated Jun. 18, 2012, 12 pages.
Quackenbush, MPEG Audio Subgroup, Panasonic Presentation, Annex 1—Audio Report, $75^{th}$ meeting, Bangkok, Thailand, Jan. 16-20, 2006, pp. 168-196.
Office Action, U.S. Appl. No. 12/278,568, dated Jul. 6, 2012, 14 pages.

* cited by examiner

[Fig. 1]
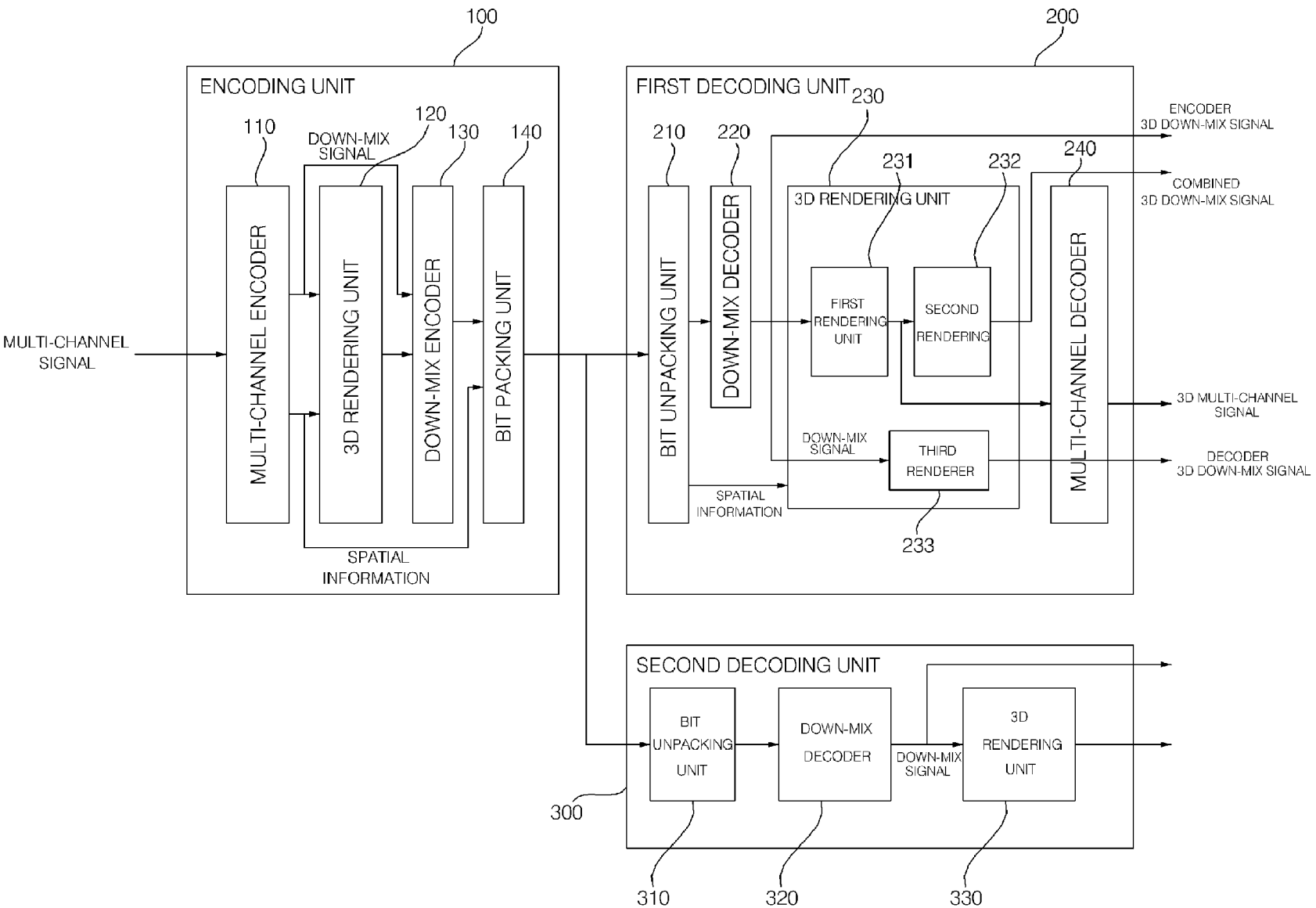

[Fig. 2]
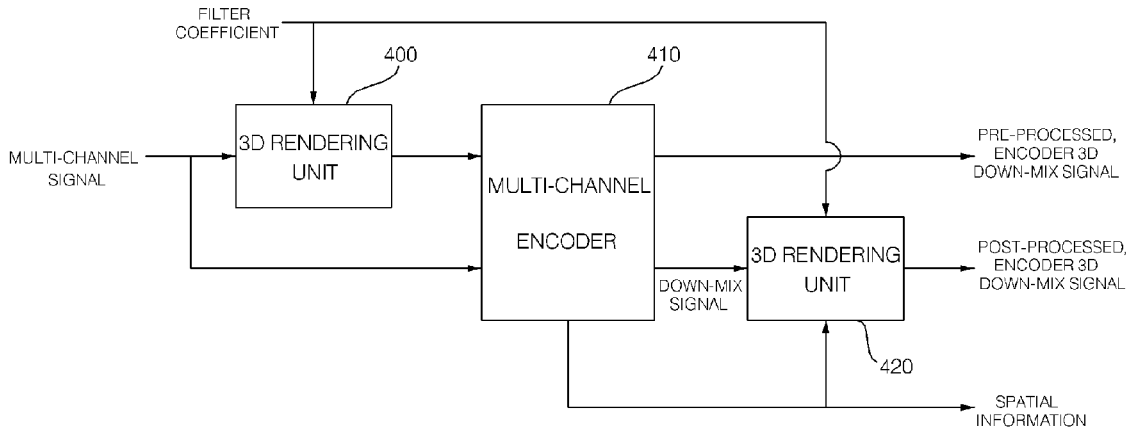
[Fig. 3]
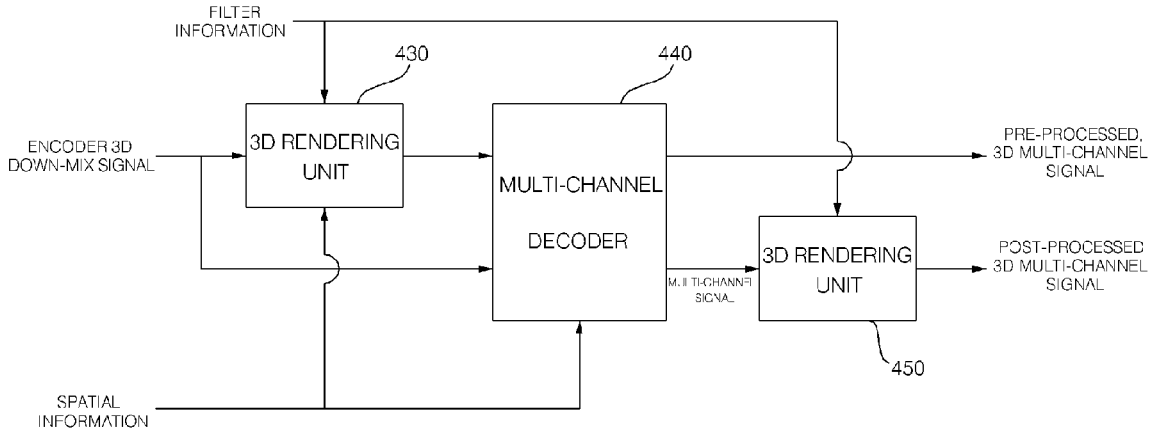
[Fig. 4]
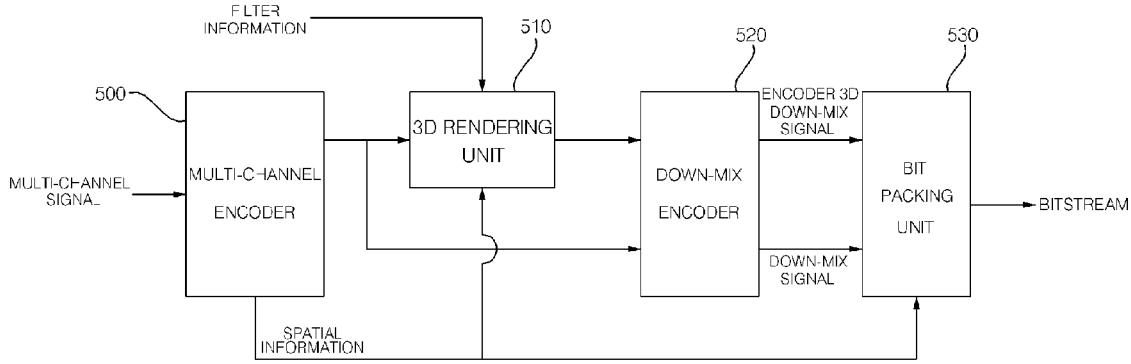

[Fig. 5]
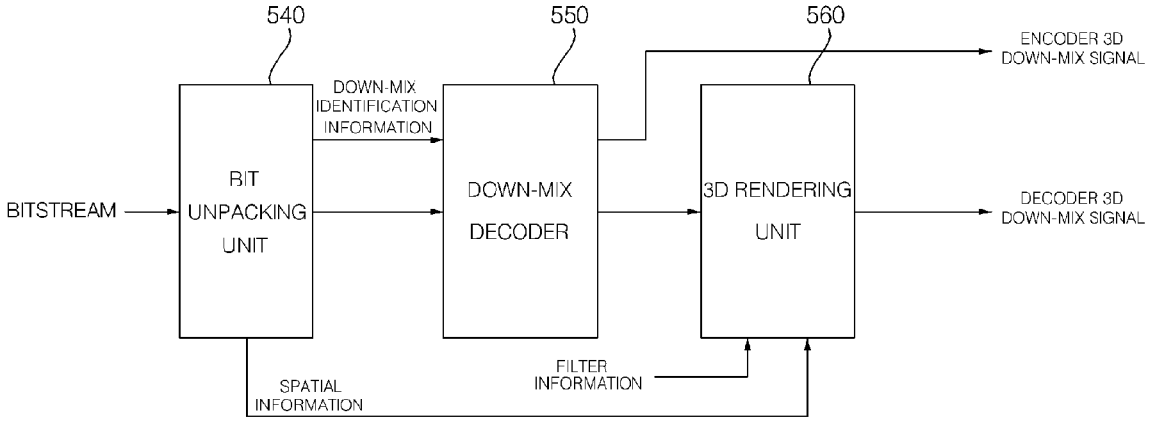
[Fig. 6]
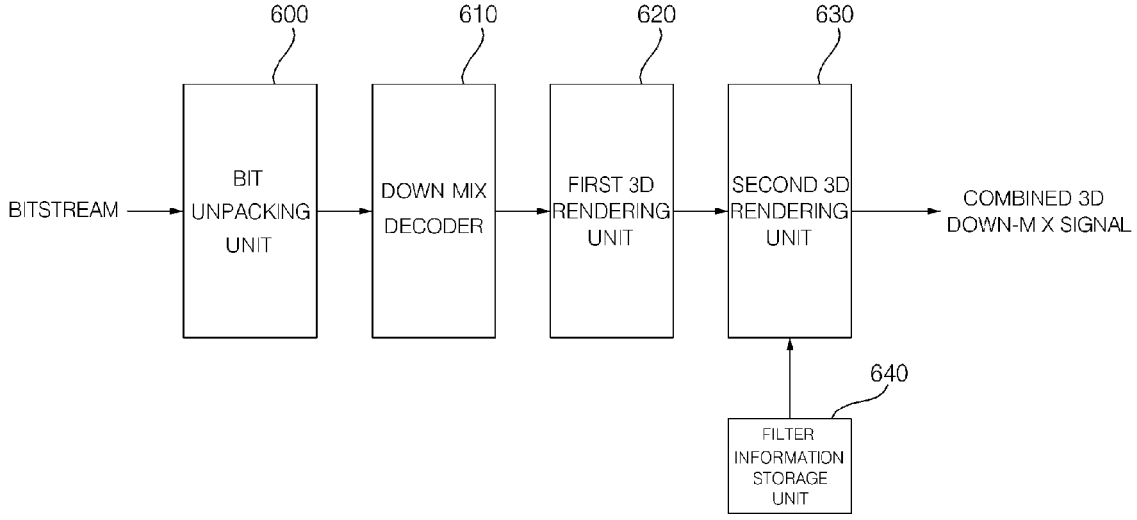

[Fig. 7]
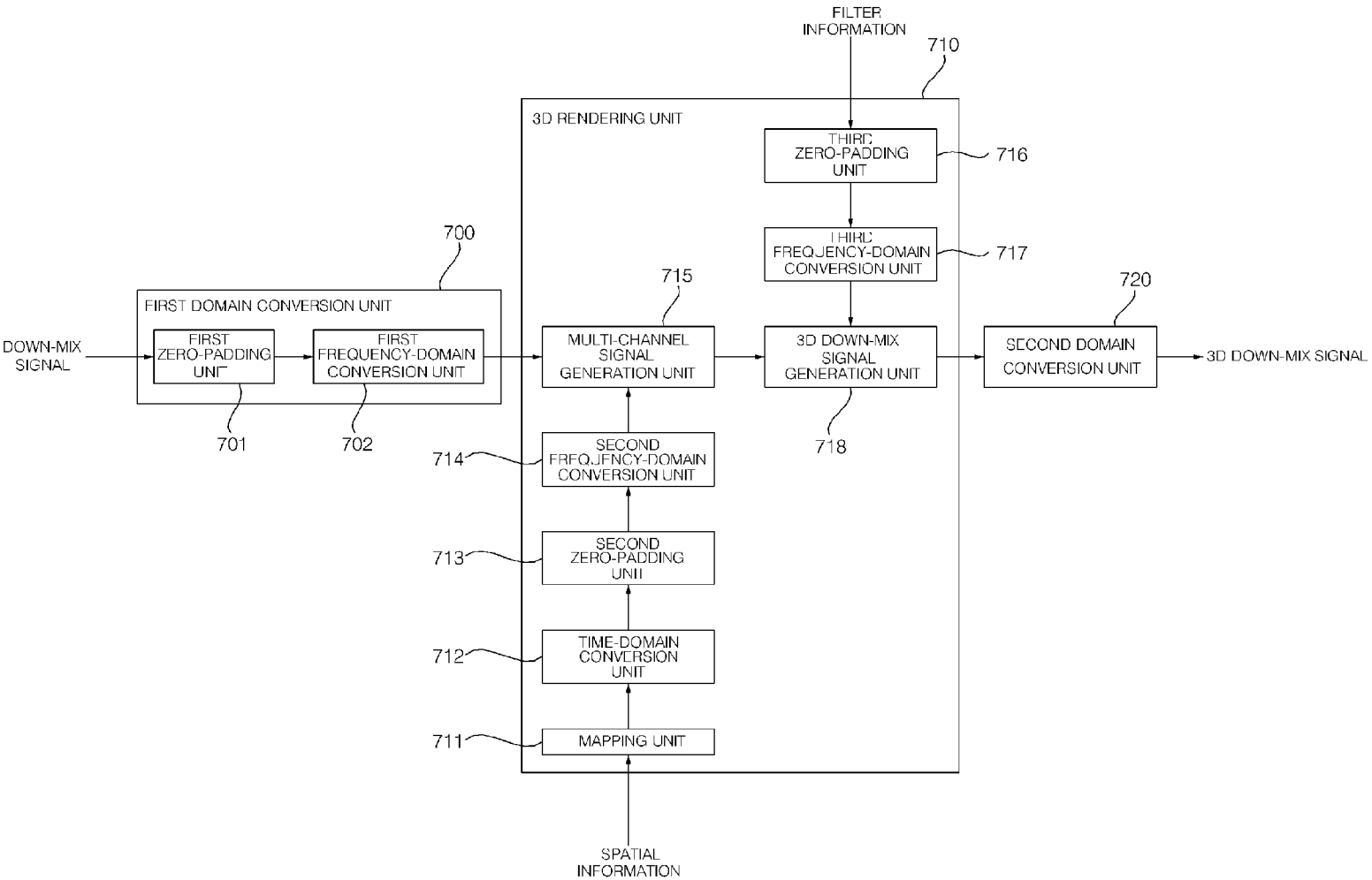
[Fig. 8]
| | | |
|---|---|---|
| HEADER | MULTI-CHANNEL DECODING INFORMATION | 3D RENDERING INFORMATION |

[Fig. 9]
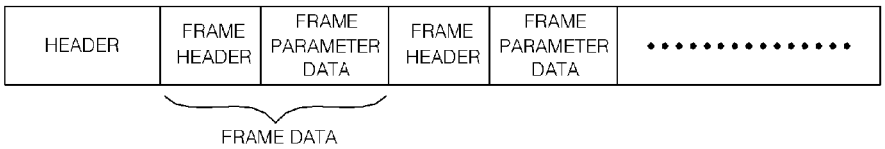
[Fig. 10]
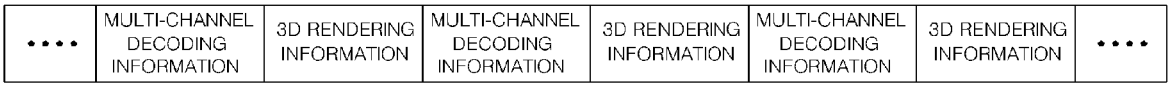
[Fig. 11]
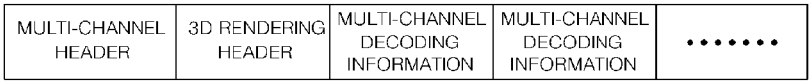

[Fig. 12]
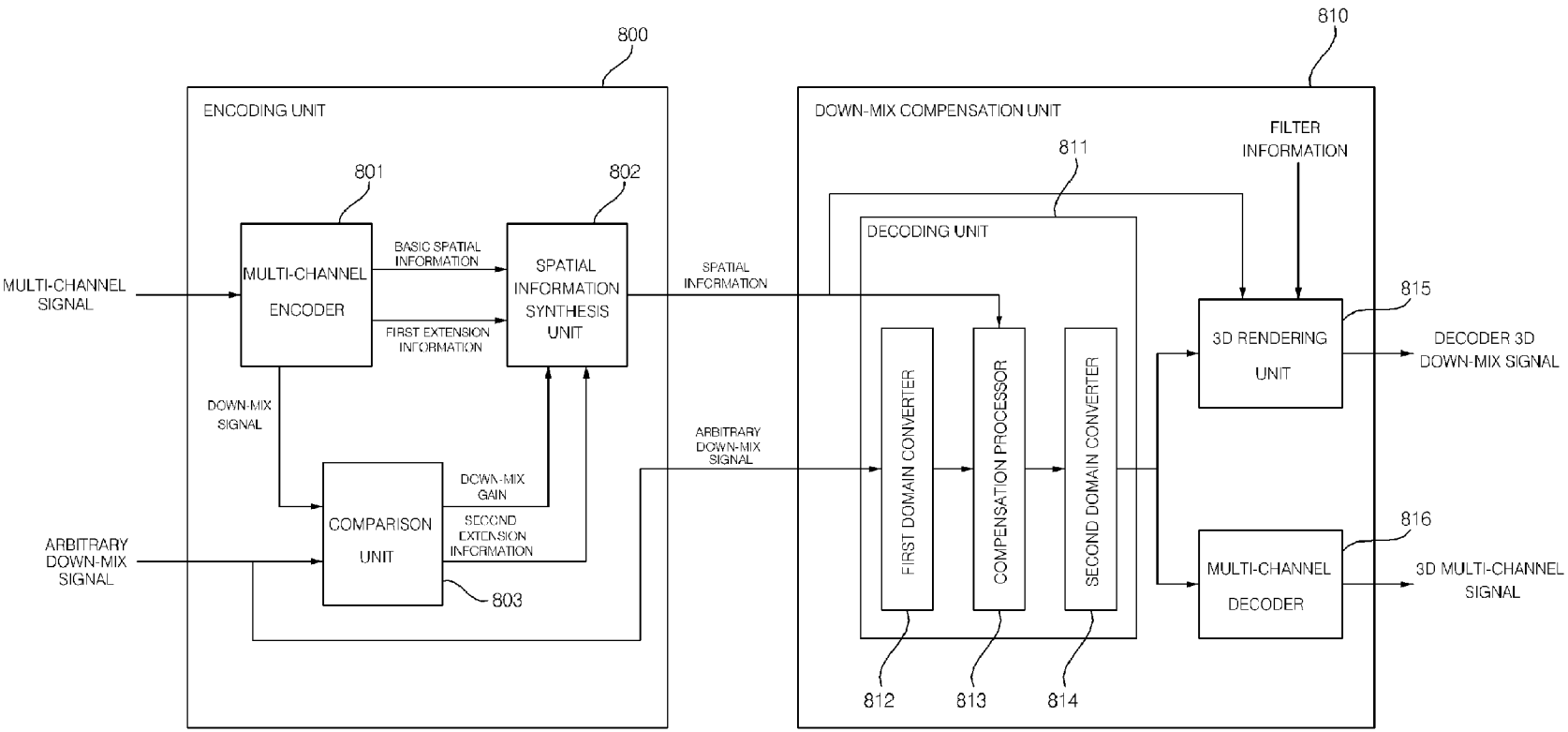

[Fig. 13]
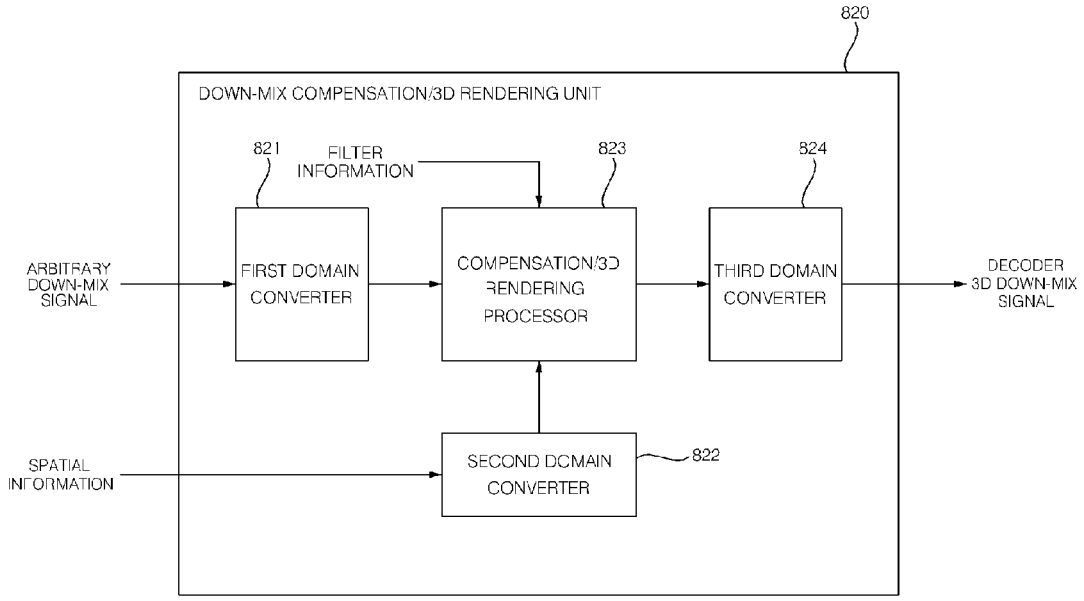
[Fig. 14]
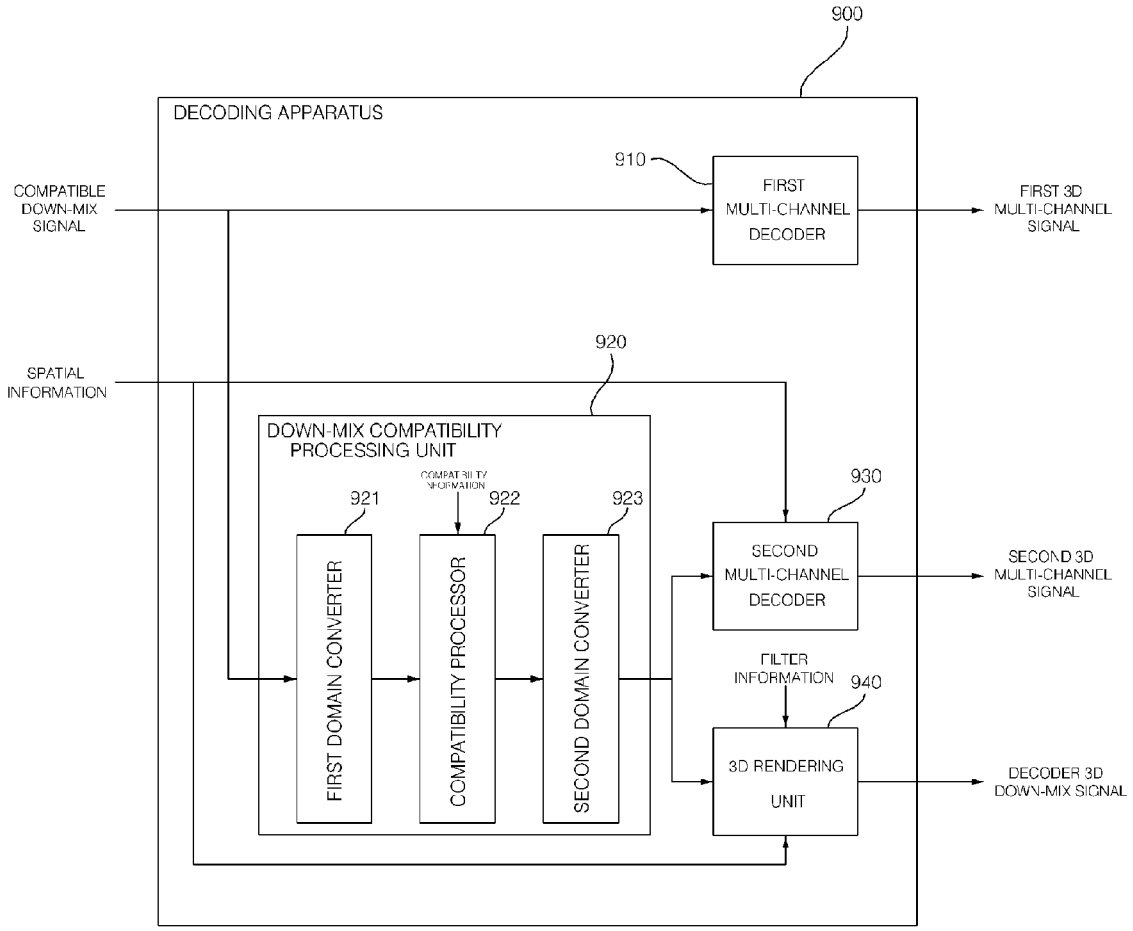

[Fig. 15]
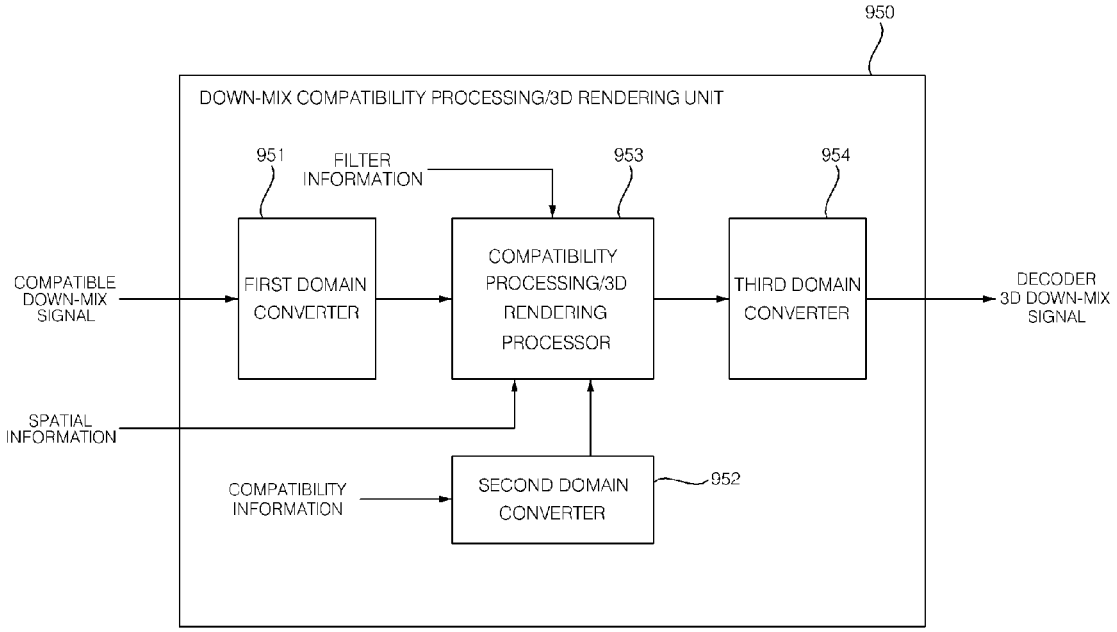
[Fig. 16]
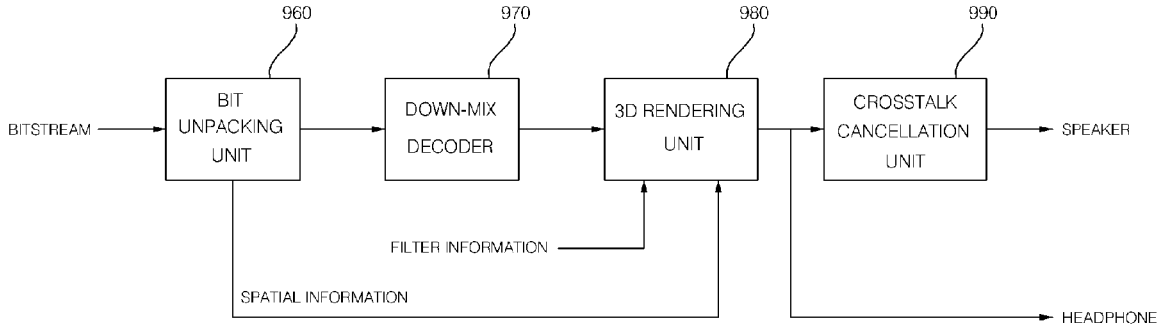

APPARATUS AND METHOD FOR ENCODING/DECODING SIGNAL

TECHNICAL FIELD

The present invention relates to an encoding/decoding method and an encoding/decoding apparatus, and more particularly, to an encoding/decoding apparatus which can process an audio signal so that three dimensional (3D) sound effects can be created, and an encoding/decoding method using the encoding/decoding apparatus.

BACKGROUND ART

An encoding apparatus down-mixes a multi-channel signal into a signal with fewer channels, and transmits the down-mixed signal to a decoding apparatus. Then, the decoding apparatus restores a multi-channel signal from the down-mixed signal and reproduces the restored multi-channel signal using three or more speakers, for example, 5.1-channel speakers.

Multi-channel signals may be reproduced by 2-channel speakers such as headphones. In this case, in order to make a user feel as if sounds output by 2-channel speakers were reproduced from three or more sound sources, it is necessary to develop three-dimensional (3D) processing techniques capable of encoding or decoding multi-channel signals so that 3D effects can be created.

DISCLOSURE OF INVENTION

Technical Problem

The present invention provides an encoding/decoding apparatus and an encoding/decoding method which can reproduce multi-channel signals in various reproduction environments by efficiently processing signals with 3D effects.

Technical Solution

According to an aspect of the present invention, there is provided a decoding method of restoring a multi-channel signal, the decoding method including extracting a three-dimensional (3D) down-mix signal and spatial information from an input bitstream, removing 3D effects from the 3D down-mix signal by performing a 3D rendering operation on the 3D down-mix signal, and generating a multi-channel signal using the spatial information and a down-mix signal obtained by the removal.

According to another aspect of the present invention, there is provided a decoding method of restoring a multi-channel signal, the decoding method including extracting a 3D down-mix signal and spatial information from an input bitstream, generating a multi-channel signal using the 3D down-mix signal and the spatial information, and removing 3D effects from the multi-channel signal by performing a 3D rendering operation on the multi-channel signal.

According to another aspect of the present invention, there is provided an encoding method of encoding a multi-channel signal with a plurality of channels, the encoding method including encoding the multi-channel signal into a down-mix signal with fewer channels, generating spatial information regarding the plurality of channels, generating a 3D down-mix signal by performing a 3D rendering operation on the down-mix signal, and generating a bitstream including the 3D down-mix signal and the spatial information.

According to another aspect of the present invention, there is provided an encoding method of encoding a multi-channel signal with a plurality of channels, the encoding method including performing a 3D rendering operation on the multi-channel signal, encoding a multi-channel signal obtained by the 3D rendering operation into a 3D down-mix signal with fewer channels, generating spatial information regarding the plurality of channels, and generating a bitstream including the 3D down-mix signal and the spatial information.

According to another aspect of the present invention, there is provided a decoding apparatus for restoring a multi-channel signal, the decoding apparatus including a bit unpacking unit which extracts an encoded 3D down-mix signal and spatial information from an input bitstream, a down-mix decoder which decodes the encoded 3D down-mix signal, a 3D rendering unit which removes 3D effects from the decoded 3D down-mix signal obtained by the decoding performed by the down-mix decoder by performing a 3D rendering operation on the decoded 3D down-mix signal, and a multi-channel decoder which generates a multi-channel signal using the spatial information and a down-mix signal obtained by the removal performed by the 3D rendering unit.

According to another aspect of the present invention, there is provided a decoding apparatus for restoring a multi-channel signal, the decoding apparatus including a bit unpacking unit which extracts an encoded 3D down-mix signal and spatial information from an input bitstream, a down-mix decoder which decodes the encoded 3D down-mix signal, a multi-channel decoder which generates a multi-channel signal using the spatial information and a 3D down-mix signal obtained by the decoding performed by the down-mix decoder, and a 3D rendering unit which removes 3D effects from the multi-channel signal by performing a 3D rendering operation on the multi-channel signal.

According to another aspect of the present invention, there is provided an encoding apparatus for encoding a multi-channel signal with a plurality of channels, the encoding apparatus including a multi-channel encoder which encodes the multi-channel signal into a down-mix signal with fewer channels and generates spatial information regarding the plurality of channels, a 3D rendering unit which generates a 3D down-mix signal by performing a 3D rendering operation on the down-mix signal, a down-mix encoder which encodes the 3D down-mix signal; and a bit packing unit which generates a bitstream including the encoded 3D down-mix signal and the spatial information.

According to another aspect of the present invention, there is provided an encoding apparatus for encoding a multi-channel signal with a plurality of channels, the encoding apparatus including a 3D rendering unit which performs a 3D rendering operation on the multi-channel signal, a multi-channel encoder which encodes a multi-channel signal obtained by the 3D rendering operation into a 3D down-mix signal with fewer channels and generates spatial information regarding the plurality of channels, a down-mix encoder which encodes the 3D down-mix signal, and a bit packing unit which generates a bitstream including the encoded 3D down-mix signal and the spatial information.

According to another aspect of the present invention, there is provided a bitstream including a data field which includes information regarding a 3D down-mix signal, a filter information field which includes filter information identifying a filter used for generating the 3D down-mix signal, a first header field which includes information indicating whether the filter information field includes the filter information, a second header field which includes information indicating whether the filter information field includes coefficients of the filter or coefficients of an inverse filter of the filter, and a spatial information field which includes spatial information regarding a plurality of channels.

According to another aspect of the present invention, there is provided a computer-readable recording medium having a computer program for executing any one of the above-described decoding methods and the above-described encoding methods.

Advantageous Effects

According to the present invention, it is possible to efficiently encode multi-channel signals with 3D effects and to adaptively restore and reproduce audio signals with optimum sound quality according to the characteristics of a reproduction environment.

BRIEF DESCRIPTION OF THE DRAWINGS

FIG. 1 is a block diagram of an encoding/decoding apparatus according to an embodiment of the present invention;

FIG. 2 is a block diagram of an encoding apparatus according to an embodiment of the present invention;

FIG. 3 is a block diagram of a decoding apparatus according to an embodiment of the present invention;

FIG. 4 is a block diagram of an encoding apparatus according to another embodiment of the present invention;

FIG. 5 is a block diagram of a decoding apparatus according to another embodiment of the present invention;

FIG. 6 is a block diagram of a decoding apparatus according to another embodiment of the present invention;

FIG. 7 is a block diagram of a three-dimensional (3D) rendering apparatus according to an embodiment of the present invention;

FIGS. 8 through 11 illustrate bitstreams according to embodiments of the present invention;

FIG. 12 is a block diagram of an encoding/decoding apparatus for processing an arbitrary down-mix signal according to an embodiment of the present invention;

FIG. 13 is a block diagram of an arbitrary down-mix signal compensation/3D rendering unit according to an embodiment of the present invention;

FIG. 14 is a block diagram of a decoding apparatus for processing a compatible down-mix signal according to an embodiment of the present invention;

FIG. 15 is a block diagram of a down-mix compatibility processing/3D rendering unit according to an embodiment of the present invention; and FIG. 16 is a block diagram of a decoding apparatus for canceling crosstalk according to an embodiment of the present invention.

BEST MODE FOR CARRYING OUT THE INVENTION

The present invention will hereinafter be described more fully with reference to the accompanying drawings, in which exemplary embodiments of the invention are shown.

FIG. 1 is a block diagram of an encoding/decoding apparatus according to an embodiment of the present invention. Referring to FIG. 1, an encoding unit 100 includes a multi-channel encoder 110, a three-dimensional (3D) rendering unit 120, a down-mix encoder 130, and a bit packing unit 140.

The multi-channel encoder 110 down-mixes a multi-channel signal with a plurality of channels into a down-mix signal such as a stereo signal or a mono signal and generates spatial information regarding the channels of the multi-channel signal. The spatial information is needed to restore a multi-channel signal from the down-mix signal.

Examples of the spatial information include a channel level difference (CLD), which indicates the difference between the energy levels of a pair of channels, a channel prediction coefficient (CPC), which is a prediction coefficient used to generate a 3-channel signal based on a 2-channel signal, inter-channel correlation (ICC), which indicates the correlation between a pair of channels, and a channel time difference (CTD), which is the time interval between a pair of channels.

The 3D rendering unit 120 generates a 3D down-mix signal based on the down-mix signal. The 3D down-mix signal may be a 2-channel signal with three or more directivities and can thus be reproduced by 2-channel speakers such as headphones with 3D effects. In other words, the 3D down-mix signal may be reproduced by 2-channel speakers so that a user can feel as if the 3D down-mix signal were reproduced from a sound source with three or more channels. The direction of a sound source may be determined based on at least one of the difference between the intensities of two sounds respectively input to both ears, the time interval between the two sounds, and the difference between the phases of the two sounds. Therefore, the 3D rendering unit 120 can convert the down-mix signal into the 3D down-mix signal based on how the humans can determine the 3D location of a sound source with their sense of hearing.

The 3D rendering unit 120 may generate the 3D down-mix signal by filtering the down-mix signal using a filter. In this case, filter-related information, for example, a coefficient of the filter, may be input to the 3D rendering unit 120 by an external source. The 3D rendering unit 120 may use the spatial information provided by the multi-channel encoder 110 to generate the 3D down-mix signal based on the down-mix signal. More specifically, the 3D rendering unit 120 may convert the down-mix signal into the 3D down-mix signal by converting the down-mix signal into an imaginary multi-channel signal using the spatial information and filtering the imaginary multi-channel signal.

The 3D rendering unit 120 may generate the 3D down-mix signal by filtering the down-mix signal using a head-related transfer function (HRTF) filter.

A HRTF is a transfer function which describes the transmission of sound waves between a sound source at an arbitrary location and the eardrum, and returns a value that varies according to the direction and altitude of a sound source. If a signal with no directivity is filtered using the HRTF, the signal may be heard as if it were reproduced from a certain direction.

The 3D rendering unit 120 may perform a 3D rendering operation in a frequency domain, for example, a discrete Fourier transform (DFT) domain or a fast Fourier transform (FFT) domain. In this case, the 3D rendering unit 120 may perform DFT or FFT before the 3D rendering operation or may perform inverse DFT (IDFT) or inverse FFT (IFFT) after the 3D rendering operation.

The 3D rendering unit 120 may perform the 3D rendering operation in a quadrature mirror filter (QMF)/hybrid domain. In this case, the 3D rendering unit 120 may perform QMF/hybrid analysis and synthesis operations before or after the 3D rendering operation.

The 3D rendering unit 120 may perform the 3D rendering operation in a time domain. The 3D rendering unit 120 may determine in which domain the 3D rendering operation is to be performed according to required sound quality and the operational capacity of the encoding/decoding apparatus.

The down-mix encoder 130 encodes the down-mix signal output by the multi-channel encoder 110 or the 3D down-mix signal output by the 3D rendering unit 120. The down-mix encoder 130 may encode the down-mix signal output by the multi-channel encoder 110 or the 3D down-mix signal output by the 3D rendering unit 120 using an audio encoding method such as an advanced audio coding (AAC) method, an MPEG layer 3 (MP3) method, or a bit sliced arithmetic coding (BSAC) method.

The down-mix encoder 130 may encode a non-3D down-mix signal or a 3D down-mix signal. In this case, the encoded non-3D down-mix signal and the encoded 3D down-mix signal may both be included in a bitstream to be transmitted.

The bit packing unit 140 generates a bitstream based on the spatial information and either the encoded non-3D down-mix signal or the encoded 3D down-mix signal.

The bitstream generated by the bit packing unit 140 may include spatial information, down-mix identification information indicating whether a down-mix signal included in the bitstream is a non-3D down-mix signal or a 3D down-mix signal, and information identifying a filter used by the 3D rendering unit 120 (e.g., HRTF coefficient information).

In other words, the bitstream generated by the bit packing unit 140 may include at least one of a non-3D down-mix signal which has not yet been 3D-processed and an encoder 3D down-mix signal which is obtained by a 3D processing operation performed by an encoding apparatus, and down-mix identification information identifying the type of down-mix signal included in the bitstream.

It may be determined which of the non-3D down-mix signal and the encoder 3D down-mix signal is to be included in the bitstream generated by the bit packing unit 140 at the user's choice or according to the capabilities of the encoding/decoding apparatus illustrated in FIG. 1 and the characteristics of a reproduction environment.

The HRTF coefficient information may include coefficients of an inverse function of a HRTF used by the 3D rendering unit 120. The HRTF coefficient information may only include brief information of coefficients of the HRTF used by the 3D rendering unit 120, for example, envelope information of the HRTF coefficients. If a bitstream including the coefficients of the inverse function of the HRTF is transmitted to a decoding apparatus, the decoding apparatus does not need to perform an HRTF coefficient conversion operation, and thus, the amount of computation of the decoding apparatus may be reduced.

The bitstream generated by the bit packing unit 140 may also include information regarding an energy variation in a signal caused by HRTF-based filtering, i.e., information regarding the difference between the energy of a signal to be filtered and the energy of a signal that has been filtered or the ratio of the energy of the signal to be filtered and the energy of the signal that has been filtered.

The bitstream generated by the bit packing unit 140 may also include information indicating whether it includes HRTF coefficients. If HRTF coefficients are included in the bitstream generated by the bit packing unit 140, the bitstream may also include information indicating whether it includes either the coefficients of the HRTF used by the 3D rendering unit 120 or the coefficients of the inverse function of the HRTF.

Referring to FIG. 1, a first decoding unit 200 includes a bit unpacking unit 210, a down-mix decoder 220, a 3D rendering unit 230, and a multi-channel decoder 240.

The bit unpacking unit 210 receives an input bitstream from the encoding unit 100 and extracts an encoded down-mix signal and spatial information from the input bitstream. The down-mix decoder 220 decodes the encoded down-mix signal. The down-mix decoder 220 may decode the encoded down-mix signal using an audio signal decoding method such as an AAC method, an MP3 method, or a BSAC method.

As described above, the encoded down-mix signal extracted from the input bitstream may be an encoded non-3D down-mix signal or an encoded, encoder 3D down-mix signal. Information indicating whether the encoded down-mix signal extracted from the input bitstream is an encoded non-3D down-mix signal or an encoded, encoder 3D down-mix signal may be included in the input bitstream.

If the encoded down-mix signal extracted from the input bitstream is an encoder 3D down-mix signal, the encoded down-mix signal may be readily reproduced after being decoded by the down-mix decoder 220.

On the other hand, if the encoded down-mix signal extracted from the input bitstream is a non-3D down-mix signal, the encoded down-mix signal may be decoded by the down-mix decoder 220, and a down-mix signal obtained by the decoding may be converted into a decoder 3D down-mix signal by a 3D rendering operation performed by the third rendering unit 233. The decoder 3D down-mix signal can be readily reproduced.

The 3D rendering unit 230 includes a first renderer 231, a second renderer 232, and a third renderer 233. The first renderer 231 generates a down-mix signal by performing a 3D rendering operation on an encoder 3D down-mix signal provided by the down-mix decoder 220. For example, the first renderer 231 may generate a non-3D down-mix signal by removing 3D effects from the encoder 3D down-mix signal. The 3D effects of the encoder 3D down-mix signal may not be completely removed by the first renderer 231. In this case, a down-mix signal output by the first renderer 231 may have some 3D effects.

The first renderer 231 may convert the 3D down-mix signal provided by the down-mix decoder 220 into a down-mix signal with 3D effects removed therefrom using an inverse filter of the filter used by the 3D rendering unit 120 of the encoding unit 100. Information regarding the filter used by the 3D rendering unit 120 or the inverse filter of the filter used by the 3D rendering unit 120 may be included in the input bitstream.

The filter used by the 3D rendering unit 120 may be an HRTF filter. In this case, the coefficients of the HRTF used by the encoding unit 100 or the coefficients of the inverse function of the HRTF may also be included in the input bitstream. If the coefficients of the HRTF used by the encoding unit 100 are included in the input bitstream, the HRTF coefficients may be inversely converted, and the results of the inverse conversion may be used during the 3D rendering operation performed by the first renderer 231. If the coefficients of the inverse function of the HRTF used by the encoding unit 100 are included in the input bitstream, they may be readily used during the 3D rendering operation performed by the first renderer 231 without being subjected to any inverse conversion operation. In this case, the amount of computation of the first decoding apparatus 100 may be reduced.

The input bitstream may also include filter information (e.g., information indicating whether the coefficients of the HRTF used by the encoding unit 100 are included in the input bitstream) and information indicating whether the filter information has been inversely converted.

The multi-channel decoder 240 generates a 3D multi-channel signal with three or more channels based on the down-mix signal with 3D effects removed therefrom and the spatial information extracted from the input bitstream.

The second renderer 232 may generate a 3D down-mix signal with 3D effects by performing a 3D rendering operation on the down-mix signal with 3D effects removed therefrom. In other words, the first renderer 231 removes 3D effects from the encoder 3D down-mix signal provided by the down-mix decoder 220. Thereafter, the second renderer 232 may generate a combined 3D down-mix signal with 3D effects desired by the first decoding apparatus 200 by performing a 3D rendering operation on a down-mix signal obtained by the removal performed by the first renderer 231, using a filter of the first decoding apparatus 200.

The first decoding apparatus 200 may include a renderer in which two or more of the first, second, and third renderers 231, 232, and 233 that perform the same operations are integrated.

A bitstream generated by the encoding unit 100 may be input to a second decoding apparatus 300 which has a different structure from the first decoding apparatus 200. The second decoding apparatus 300 may generate a 3D down-mix signal based on a down-mix signal included in the bitstream input thereto.

More specifically, the second decoding apparatus 300 includes a bit unpacking unit 310, a down-mix decoder 320, and a 3D rendering unit 330. The bit unpacking unit 310 receives an input bitstream from the encoding unit 100 and extracts an encoded down-mix signal and spatial information from the input bitstream. The down-mix decoder 320 decodes the encoded down-mix signal. The 3D rendering unit 330 performs a 3D rendering operation on the decoded down-mix signal so that the decoded down-mix signal can be converted into a 3D down-mix signal.

FIG. 2 is a block diagram of an encoding apparatus according to an embodiment of the present invention. Referring to FIG. 2, the encoding apparatus includes rendering units 400 and 420 and a multi-channel encoder 410. Detailed descriptions of the same encoding processes as those of the embodiment of FIG. 1 will be omitted.

Referring to FIG. 2, the 3D rendering units 400 and 420 may be respectively disposed in front of and behind the multi-channel encoder 410. Thus, a multi-channel signal may be 3D-rendered by the 3D rendering unit 400, and then, the 3D-rendered multi-channel signal may be encoded by the multi-channel encoder 410, thereby generating a pre-processed, encoder 3D down-mix signal. Alternatively, the multi-channel signal may be down-mixed by the multi-channel encoder 410, and then, the down-mixed signal may be 3D-rendered by the 3D rendering unit 420, thereby generating a post-processed, encoder down-mix signal.

Information indicating whether the multi-channel signal has been 3D-rendered before or after being down-mixed may be included in a bitstream to be transmitted.

The 3D rendering units 400 and 420 may both be disposed in front of or behind the multi-channel encoder 410.

FIG. 3 is a block diagram of a decoding apparatus according to an embodiment of the present invention. Referring to FIG. 3, the decoding apparatus includes 3D rendering units 430 and 450 and a multi-channel decoder 440. Detailed descriptions of the same decoding processes as those of the embodiment of FIG. 1 will be omitted.

Referring to FIG. 3, the 3D rendering units 430 and 450 may be respectively disposed in front of and behind the multi-channel decoder 440. The 3D rendering unit 430 may remove 3D effects from an encoder 3D down-mix signal and input a down-mix signal obtained by the removal to the multi-channel decoder 430. Then, the multi-channel decoder 430 may decode the down-mix signal input thereto, thereby generating a pre-processed 3D multi-channel signal. Alternatively, the multi-channel decoder 430 may restore a multi-channel signal from an encoded 3D down-mix signal, and the 3D rendering unit 450 may remove 3D effects from the restored multi-channel signal, thereby generating a post-processed 3D multi-channel signal.

If an encoder 3D down-mix signal provided by an encoding apparatus has been generated by performing a 3D rendering operation and then a down-mixing operation, the encoder 3D down-mix signal may be decoded by performing a multi-channel decoding operation and then a 3D rendering operation. On the other hand, if the encoder 3D down-mix signal has been generated by performing a down-mixing operation and then a 3D rendering operation, the encoder 3D down-mix signal may be decoded by performing a 3D rendering operation and then a multi-channel decoding operation.

Information indicating whether an encoded 3D down-mix signal has been obtained by performing a 3D rendering operation before or after a down-mixing operation may be extracted from a bitstream transmitted by an encoding apparatus.

The 3D rendering units 430 and 450 may both be disposed in front of or behind the multi-channel decoder 440.

FIG. 4 is a block diagram of an encoding apparatus according to another embodiment of the present invention. Referring to FIG. 4, the encoding apparatus includes a multi-channel encoder 500, a 3D rendering unit 510, a down-mix encoder 520, and a bit packing unit 530. Detailed descriptions of the same encoding processes as those of the embodiment of FIG. 1 will be omitted.

Referring to FIG. 4, the multi-channel encoder 500 generates a down-mix signal and spatial information based on an input multi-channel signal. The 3D rendering unit 510 generates a 3D down-mix signal by performing a 3D rendering operation on the down-mix signal.

It may be determined whether to perform a 3D rendering operation on the down-mix signal at a user's choice or according to the capabilities of the encoding apparatus, the characteristics of a reproduction environment, or required sound quality.

The down-mix encoder 520 encodes the down-mix signal generated by the multi-channel encoder 500 or the 3D down-mix signal generated by the 3D rendering unit 510.

The bit packing unit 530 generates a bitstream based on the spatial information and either the encoded down-mix signal or an encoded, encoder 3D down-mix signal. The bitstream generated by the bit packing unit 530 may include down-mix identification information indicating whether an encoded down-mix signal included in the bitstream is a non-3D down-mix signal with no 3D effects or an encoder 3D down-mix signal with 3D effects. More specifically, the down-mix identification information may indicate whether the bitstream generated by the bit packing unit 530 includes a non-3D down-mix signal, an encoder 3D down-mix signal or both.

FIG. 5 is a block diagram of a decoding apparatus according to another embodiment of the present invention. Referring to FIG. 5, the decoding apparatus includes a bit unpacking unit 540, a down-mix decoder 550, and a 3D rendering unit 560. Detailed descriptions of the same decoding processes as those of the embodiment of FIG. 1 will be omitted.

Referring to FIG. 5, the bit unpacking unit 540 extracts an encoded down-mix signal, spatial information, and down-mix identification information from an input bitstream. The down-mix identification information indicates whether the encoded down-mix signal is an encoded non-3D down-mix signal with no 3D effects or an encoded 3D down-mix signal with 3D effects.

If the input bitstream includes both a non-3D down-mix signal and a 3D down-mix signal, only one of the non-3D down-mix signal and the 3D down-mix signal may be extracted from the input bitstream at a user's choice or according to the capabilities of the decoding apparatus, the characteristics of a reproduction environment or required sound quality.

The down-mix decoder 550 decodes the encoded down-mix signal. If a down-mix signal obtained by the decoding performed by the down-mix decoder 550 is an encoder 3D down-mix signal obtained by performing a 3D rendering operation, the down-mix signal may be readily reproduced.

On the other hand, if the down-mix signal obtained by the decoding performed by the down-mix decoder 550 is a down-mix signal with no 3D effects, the 3D rendering unit 560 may generate a decoder 3D down-mix signal by performing a 3D rendering operation on the down-mix signal obtained by the decoding performed by the down-mix decoder 550.

FIG. 6 is a block diagram of a decoding apparatus according to another embodiment of the present invention. Referring to FIG. 6, the decoding apparatus includes a bit unpacking unit 600, a down-mix decoder 610, a first 3D rendering unit 620, a second 3D rendering unit 630, and a filter information storage unit 640. Detailed descriptions of the same decoding processes as those of the embodiment of FIG. 1 will be omitted.

The bit unpacking unit 600 extracts an encoded, encoder 3D down-mix signal and spatial information from an input bitstream. The down-mix decoder 610 decodes the encoded, encoder 3D down-mix signal.

The first 3D rendering unit 620 removes 3D effects from an encoder 3D down-mix signal obtained by the decoding performed by the down-mix decoder 610, using an inverse filter of a filter of an encoding apparatus used for performing a 3D rendering operation. The second rendering unit 630 generates a combined 3D down-mix signal with 3D effects by performing a 3D rendering operation on a down-mix signal obtained by the removal performed by the first 3D rendering unit 620, using a filter stored in the decoding apparatus.

The second 3D rendering unit 630 may perform a 3D rendering operation using a filter having different characteristics from the filter of the encoding unit used to perform a 3D rendering operation. For example, the second 3D rendering unit 630 may perform a 3D rendering operation using an HRTF having different coefficients from those of an HRTF used by an encoding apparatus.

The filter information storage unit 640 stores filter information regarding a filter used to perform a 3D rendering, for example, HRTF coefficient information. The second 3D rendering unit 630 may generate a combined 3D down-mix using the filter information stored in the filter information storage unit 640.

The filter information storage unit 640 may store a plurality of pieces of filter information respectively corresponding to a plurality of filters. In this case, one of the plurality of pieces of filter information may be selected at a user's choice or according to the capabilities of the decoding apparatus or required sound quality.

People from different races may have different ear structures. Thus, HRTF coefficients optimized for different individuals may differ from one another. The decoding apparatus illustrated in FIG. 6 can generate a 3D down-mix signal optimized for the user. In addition, the decoding apparatus illustrated in FIG. 6 can generate a 3D down-mix signal with 3D effects corresponding to an HRTF filter desired by the user, regardless of the type of HRTF provided by a 3D down-mix signal provider.

FIG. 7 is a block diagram of a 3D rendering apparatus according to an embodiment of the present invention. Referring to FIG. 7, the 3D rendering apparatus includes first and second domain conversion units 700 and 720 and a 3D rendering unit 710. In order to perform a 3D rendering operation in a predetermined domain, the first and second domain conversion units 700 and 720 may be respectively disposed in front of and behind the 3D rendering unit 710.

Referring to FIG. 7, an input down-mix signal is converted into a frequency-domain down-mix signal by the first domain conversion unit 700. More specifically, the first domain conversion unit 700 may convert the input down-mix signal into a DFT-domain down-mix signal or a FFT-domain down-mix signal by performing DFT or FFT.

The 3D rendering unit 710 generates a multi-channel signal by applying spatial information to the frequency-domain down-mix signal provided by the first domain conversion unit 700. Thereafter, the 3D rendering unit 710 generates a 3D down-mix signal by filtering the multi-channel signal.

The 3D down-mix signal generated by the 3D rendering unit 710 is converted into a time-domain 3D down-mix signal by the second domain conversion unit 720. More specifically, the second domain conversion unit 720 may perform IDFT or IFFT on the 3D down-mix signal generated by the 3D rendering unit 710.

During the conversion of a frequency-domain 3D down-mix signal into a time-domain 3D down-mix signal, data loss or data distortion such as aliasing may occur.

In order to generate a multi-channel signal and a 3D down-mix signal in a frequency domain, spatial information for each parameter band may be mapped to the frequency domain, and a number of filter coefficients may be converted to the frequency domain.

The 3D rendering unit 710 may generate a 3D down-mix signal by multiplying the frequency-domain down-mix signal provided by the first domain conversion unit 700, the spatial information, and the filter coefficients.

A time-domain signal obtained by multiplying a down-mix signal, spatial information and a plurality of filter coefficients that are all represented in an M-point frequency domain has M valid signals. In order to represent the down-mix signal, the spatial information and the filter in the M-point frequency domain, M-point DFT or M-point FFT may be performed.

Valid signals are signals that do not necessarily have a value of 0. For example, a total of x valid signals can be generated by obtaining x signals from an audio signal through sampling. Of the x valid signals, y valid signals may be zero-padded. Then, the number of valid signals is reduced to (x−y). Thereafter, a signal with a valid signals and a signal with b valid signals are convoluted, thereby obtaining a total of (a+b−1) valid signals.

The multiplication of the down-mix signal, the spatial information, and the filter coefficients in the M-point frequency domain can provide the same effect as convoluting the down-mix signal, the spatial information, and the filter coefficients in a time-domain. A signal with (3*M−2) valid signals can be generated by converting the down-mix signal, the spatial information and the filter coefficients in the M-point frequency domain to a time domain and convoluting the results of the conversion.

Therefore, the number of valid signals of a signal obtained by multiplying a down-mix signal, spatial information, and filter coefficients in a frequency domain and converting the result of the multiplication to a time domain may differ from the number of valid signals of a signal obtained by convoluting the down-mix signal, the spatial information, and the filter coefficients in the time domain. As a result, aliasing may occur during the conversion of a 3D down-mix signal in a frequency domain into a time-domain signal.

In order to prevent aliasing, the sum of the number of valid signals of a down-mix signal in a time domain, the number of valid signals of spatial information mapped to a frequency domain, and the number of filter coefficients must not be greater than M. The number of valid signals of spatial information mapped to a frequency domain may be determined by the number of points of the frequency domain. In other words, if spatial information represented for each parameter band is mapped to an N-point frequency domain, the number of valid signals of the spatial information may be N.

Referring to FIG. 7, the first domain conversion unit 700 includes a first zero-padding unit 701 and a first frequency-domain conversion unit 702. The third rendering unit 710 includes a mapping unit 711, a time-domain conversion unit 712, a second zero-padding unit 713, a second frequency-domain conversion unit 714, a multi-channel signal generation unit 715, a third zero-padding unit 716, a third frequency-domain conversion unit 717, and a 3D down-mix signal generation unit 718.

The first zero-padding unit 701 performs a zero-padding operation on a down-mix signal with X samples in a time domain so that the number of samples of the down-mix signal can be increased from X to M. The first frequency-domain conversion unit 702 converts the zero-padded down-mix signal into an M-point frequency-domain signal. The zero-padded down-mix signal has M samples. Of the M samples of the zero-padded down-mix signal, only X samples are valid signals.

The mapping unit 711 maps spatial information for each parameter band to an N-point frequency domain. The time-domain conversion unit 712 converts spatial information obtained by the mapping performed by the mapping unit 711 to a time domain. Spatial information obtained by the conversion performed by the time-domain conversion unit 712 has N samples.

The second zero-padding unit 713 performs a zero-padding operation on the spatial information with N samples in the time domain so that the number of samples of the spatial information can be increased from N to M. The second frequency-domain conversion unit 714 converts the zero-padded spatial information into an M-point frequency-domain signal. The zero-padded spatial information has N samples. Of the N samples of the zero-padded spatial information, only N samples are valid.

The multi-channel signal generation unit 715 generates a multi-channel signal by multiplying the down-mix signal provided by the first frequency-domain conversion unit 712 and spatial information provided by the second frequency-domain conversion unit 714. The multi-channel signal generated by the multi-channel signal generation unit 715 has M valid signals. On the other hand, a multi-channel signal obtained by convoluting, in the time domain, the down-mix signal provided by the first frequency-domain conversion unit 712 and the spatial information provided by the second frequency-domain conversion unit 714 has (X+N−1) valid signals.

The third zero-padding unit 716 may perform a zero-padding operation on Y filter coefficients that are represented in the time domain so that the number of samples can be increased to M. The third frequency-domain conversion unit 717 converts the zero-padded filter coefficients to the M-point frequency domain. The zero-padded filter coefficients have M samples. Of the M samples, only Y samples are valid signals.

The 3D down-mix signal generation unit 718 generates a 3D down-mix signal by multiplying the multi-channel signal generated by the multi-channel signal generation unit 715 and a plurality of filter coefficients provided by the third frequency-domain conversion unit 717. The 3D down-mix signal generated by the 3D down-mix signal generation unit 718 has M valid signals. On the other hand, a 3D down-mix signal obtained by convoluting, in the time domain, the multi-channel signal generated by the multi-channel signal generation unit 715 and the filter coefficients provided by the third frequency-domain conversion unit 717 has (X+N+Y−2) valid signals.

It is possible to prevent aliasing by setting the M-point frequency domain used by the first, second, and third frequency-domain conversion units 702, 714, and 717 to satisfy the following equation: $M \geqq (X+N+Y-2)$. In other words, it is possible to prevent aliasing by enabling the first, second, and third frequency-domain conversion units 702, 714, and 717 to perform M-point DFT or M-point FFT that satisfies the following equation: $M \geqq (X+N+Y-2)$.

The conversion to a frequency domain may be performed using a filter bank other than a DFT filter bank, an FFT filter bank, and QMF bank. The generation of a 3D down-mix signal may be performed using an HRTF filter.

The number of valid signals of spatial information may be adjusted using a method other than the above-mentioned methods or may be adjusted using one of the above-mentioned methods that is most efficient and requires the least amount of computation.

Aliasing may occur not only during the conversion of a signal, a coefficient or spatial information from a frequency domain to a time domain or vice versa but also during the conversion of a signal, a coefficient or spatial information from a QMF domain to a hybrid domain or vice versa. The above-mentioned methods of preventing aliasing may also be used to prevent aliasing from occurring during the conversion of a signal, a coefficient or spatial information from a QMF domain to a hybrid domain or vice versa.

Spatial information used to generate a multi-channel signal or a 3D down-mix signal may vary. As a result of the variation of the spatial information, signal discontinuities may occur as noise in an output signal.

Noise in an output signal may be reduced using a smoothing method by which spatial information can be prevented from rapidly varying.

For example, when first spatial information applied to a first frame differs from second spatial information applied to a second frame when the first frame and the second frame are adjacent to each other, a discontinuity is highly likely to occur between the first and second frames.

In this case, the second spatial information may be compensated for using the first spatial information or the first spatial information may be compensated for using the second spatial information so that the difference between the first spatial information and the second spatial information can be reduced, and that noise caused by the discontinuity between the first and second frames can be reduced. More specifically, at least one of the first spatial information and the second spatial information may be replaced with the average of the first spatial information and the second spatial information, thereby reducing noise.

Noise is also likely to be generated due to a discontinuity between a pair of adjacent parameter bands. For example, when third spatial information corresponding to a first parameter band differs from fourth spatial information corresponding to a second parameter band when the first and second parameter bands are adjacent to each other, a discontinuity is likely to occur between the first and second parameter bands.

In this case, the third spatial information may be compensated for using the fourth spatial information or the fourth spatial information may be compensated for using the third spatial information so that the difference between the third spatial information and the fourth spatial information can be reduced, and that noise caused by the discontinuity between the first and second parameter bands can be reduced. More specifically, at least one of the third spatial information and the fourth spatial information may be replaced with the average of the third spatial information and the fourth spatial information, thereby reducing noise.

Noise caused by a discontinuity between a pair of adjacent frames or a pair of adjacent parameter bands may be reduced using methods other than the above-mentioned methods.

More specifically, each frame may be multiplied by a window such as a Hanning window, and an "overlap and add" scheme may be applied to the results of the multiplication so that the variations between the frames can be reduced. Alternatively, an output signal to which a plurality of pieces of spatial information are applied may be smoothed so that variations between a plurality of frames of the output signal can be prevented.

The decorrelation between channels in a DFT domain using spatial information, for example, ICC, may be adjusted as follows.

The degree of decorrelation may be adjusted by multiplying a coefficient of a signal input to a one-to-two (OTT) or two-to-three (TTT) box by a predetermined value. The predetermined value can be defined by the following equation: (A+(1−A*A)^A0.5*i) where A indicates an ICC value applied to a predetermined band of the OTT or TTT box and i indicates an imaginary part. The imaginary part may be positive or negative.

The predetermined value may accompany a weighting factor according to the characteristics of the signal, for example, the energy level of the signal, the energy characteristics of each frequency of the signal, or the type of box to which the ICC value A is applied. As a result of the introduction of the weighting factor, the degree of decorrelation may be further adjusted, and interframe smoothing or interpolation may be applied.

As described above with reference to FIG. 7, a 3D down-mix signal may be generated in a frequency domain by using an HRTF or a head related impulse response (HRIR), which is converted to the frequency domain.

Alternatively, a 3D down-mix signal may be generated by convoluting an HRIR and a down-mix signal in a time domain. A 3D down-mix signal generated in a frequency domain may be left in the frequency domain without being subjected to inverse domain transform.

In order to convolute an HRIR and a down-mix signal in a time domain, a finite impulse response (FIR) filter or an infinite impulse response (IIR) filter may be used.

As described above, an encoding apparatus or a decoding apparatus according to an embodiment of the present invention may generate a 3D down-mix signal using a first method that involves the use of an HRTF in a frequency domain or an HRIR converted to the frequency domain, a second method that involves convoluting an HRIR in a time domain, or the combination of the first and second methods.

FIGS. 8 through 11 illustrate bitstreams according to embodiments of the present invention.

Referring to FIG. 8, a bitstream includes a multi-channel decoding information field which includes information necessary for generating a multi-channel signal, a 3D rendering information field which includes information necessary for generating a 3D down-mix signal, and a header field which includes header information necessary for using the information included in the multi-channel decoding information field and the information included in the 3D rendering information field. The bitstream may include only one or two of the multi-channel decoding information field, the 3D rendering information field, and the header field.

Referring to FIG. 9, a bitstream, which contains side information necessary for a decoding operation, may include a specific configuration header field which includes header information of a whole encoded signal and a plurality of frame data fields which includes side information regarding a plurality of frames. More specifically, each of the frame data fields may include a frame header field which includes header information of a corresponding frame and a frame parameter data field which includes spatial information of the corresponding frame. Alternatively, each of the frame data fields may include a frame parameter data field only.

Each of the frame parameter data fields may include a plurality of modules, each module including a flag and parameter data. The modules are data sets including parameter data such as spatial information and other data such as down-mix gain and smoothing data which is necessary for improving the sound quality of a signal.

If module data regarding information specified by the frame header fields is received without any additional flag, if the information specified by the frame header fields is further classified, or if an additional flag and data are received in connection with information not specified by the frame header, module data may not include any flag.

Side information regarding a 3D down-mix signal, for example, HRTF coefficient information, may be included in at least one of the specific configuration header field, the frame header fields, and the frame parameter data fields.

Referring to FIG. 10, a bitstream may include a plurality of multi-channel decoding information fields which include information necessary for generating multi-channel signals and a plurality of 3D rendering information fields which include information necessary for generating 3D down-mix signals.

When receiving the bitstream, a decoding apparatus may use either the multi-channel decoding information fields or the 3D rendering information field to perform a decoding operation and skip whichever of the multi-channel decoding information fields and the 3D rendering information fields are not used in the decoding operation. In this case, it may be determined which of the multi-channel decoding information fields and the 3D rendering information fields are to be used to perform a decoding operation according to the type of signals to be reproduced.

In other words, in order to generate multi-channel signals, a decoding apparatus may skip the 3D rendering information fields, and read information included in the multi-channel decoding information fields. On the other hand, in order to generate 3D down-mix signals, a decoding apparatus may skip the multi-channel decoding information fields, and read information included in the 3D rendering information fields.

Methods of skipping some of a plurality of fields in a bitstream are as follows.

First, field length information regarding the size in bits of a field may be included in a bitstream. In this case, the field may be skipped by skipping a number of bits corresponding to the size in bits of the field. The field length information may be disposed at the beginning of the field.

Second, a syncword may be disposed at the end or the beginning of a field. In this case, the field may be skipped by locating the field based on the location of the syncword.

Third, if the length of a field is determined in advance and fixed, the field may be skipped by skipping an amount of data corresponding to the length of the field. Fixed field length information regarding the length of the field may be included in a bitstream or may be stored in a decoding apparatus.

Fourth, one of a plurality of fields may be skipped using the combination of two or more of the above-mentioned field skipping methods.

Field skip information, which is information necessary for skipping a field such as field length information, syncwords, or fixed field length information may be included in one of the specific configuration header field, the frame header fields, and the frame parameter data fields illustrated in FIG. 9 or may be included in a field other than those illustrated in FIG. 9.

For example, in order to generate multi-channel signals, a decoding apparatus may skip the 3D rendering information fields with reference to field length information, a syncword, or fixed field length information disposed at the beginning of each of the 3D rendering information fields, and read information included in the multi-channel decoding information fields.

On the other hand, in order to generate 3D down-mix signals, a decoding apparatus may skip the multi-channel decoding information fields with reference to field length information, a syncword, or fixed field length information disposed at the beginning of each of the multi-channel decoding information fields, and read information included in the 3D rendering information fields.

A bitstream may include information indicating whether data included in the bitstream is necessary for generating multi-channel signals or for generating 3D down-mix signals.

However, even if a bitstream does not include any spatial information such as CLD but includes only data (e.g., HRTF filter coefficients) necessary for generating a 3D down-mix signal, a multi-channel signal can be reproduced through decoding using the data necessary for generating a 3D down-mix signal without a requirement of the spatial information.

For example, a stereo parameter, which is spatial information regarding two channels, is obtained from a down-mix signal. Then, the stereo parameter is converted into spatial information regarding a plurality of channels to be reproduced, and a multi-channel signal is generated by applying the spatial information obtained by the conversion to the down-mix signal.

On the other hand, even if a bitstream includes only data necessary for generating a multi-channel signal, a down-mix signal can be reproduced without a requirement of an additional decoding operation or a 3D down-mix signal can be reproduced by performing 3D processing on the down-mix signal using an additional HRTF filter.

If a bitstream includes both data necessary for generating a multi-channel signal and data necessary for generating a 3D down-mix signal, a user may be allowed to decide whether to reproduce a multi-channel signal or a 3D down-mix signal.

Methods of skipping data will hereinafter be described in detail with reference to respective corresponding syntaxes.

Syntax 1 indicates a method of decoding an audio signal in units of frames.

[Syntax 1]

```
SpatialFrame( )
{
    FramingInfo( );
    bsIndependencyFlag;
    OttData( );
    TttData( );
    SmgData( );
    TempShapeData( );
    if (bsArbitraryDownmix) {
        ArbitraryDownmixData( );
    }
    if (bsResidualCoding) {
```

-continued

[Syntax 1]

```
        ResidualData( );
    }
}
```

In Syntax 1, Ottdata( ) and TttData( ) are modules which represent parameters (such as spatial information including a CLD, ICC, and CPC) necessary for restoring a multi-channel signal from a down-mix signal, and SmgData( ), TempShapeData( ), Arbitrary-DownmixData( ), and ResidualData( ) are modules which represent information necessary for improving the quality of sound by correcting signal distortions that may have occurred during an encoding operation.

For example, if a parameter such as a CLD, ICC or CPC and information included in the module ArbitraryDownmixData( ) are only used during a decoding operation, the modules SmgData( ) and TempShapeData( ), which are disposed between the modules TttData( ) and ArbitraryDownmixData( ), may be unnecessary. Thus, it is efficient to skip the modules SmgData( ) and TempShapeData( ).

A method of skipping modules according to an embodiment of the present invention will hereinafter be described in detail with reference to Syntax 2 below.

[Syntax 2]

```
    :
TttData( );
SkipData( ){
    bsSkipBits;
}
SmgData( );
TempShapeData( );
if (bsArbitraryDownmix) {
    ArbitraryDownmixData( );
}
    :
```

Referring to Syntax 2, a module SkipData( ) may be disposed in front of a module to be skipped, and the size in bits of the module to be skipped is specified in the module SkipData( ) as bsSkipBits.

In other words, assuming that modules SmgData( ) and TempShapeData( ) are to be skipped, and that the size in bits of the modules SmgData( ) and TempShapeData( ) combined is 150, the modules SmgData( ) and TempShapeData( ) can be skipped by setting bsSkipBits to 150.

A method of skipping modules according to another embodiment of the present invention will hereinafter be described in detail with reference to Syntax 3.

[Syntax 3]

```
    :
TttData( );
bsSkipSyncflag;
SmgData( );
TempShapeData( );
bsSkipSyncword;
if (bsArbitraryDownmix) {
    ArbitraryDownmixData( );
}
:
```

Referring to Syntax 3, an unnecessary module may be skipped by using bsSkipSyncflag, which is a flag indicating whether to use a syncword, and bsSkipSyncword, which is a syncword that can be disposed at the end of a module to be skipped.

More specifically, if the flag bsSkipSyncflag is set such that a syncword can be used, one or more modules between the flag bsSkipSyncflag and the syncword bsSkipSyncword, i.e., modules SmgData( ) and TempShapeData( ), may be skipped.

Referring to FIG. 11, a bitstream may include a multi-channel header field which includes header information necessary for reproducing a multi-channel signal, a 3D rendering header field which includes header information necessary for reproducing a 3D down-mix signal, and a plurality of multi-channel decoding information fields, which include data necessary for reproducing a multi-channel signal.

In order to reproduce a multi-channel signal, a decoding apparatus may skip the 3D rendering header field, and read data from the multi-channel header field and the multi-channel decoding information fields.

A method of skipping the 3D rendering header field is the same as the field skipping methods described above with reference to FIG. 10, and thus, a detailed description thereof will be skipped.

In order to reproduce a 3D down-mix signal, a decoding apparatus may read data from the multi-channel decoding information fields and the 3D rendering header field. For example, a decoding apparatus may generate a 3D down-mix signal using a down-mix signal included in the multi-channel decoding information field and HRTF coefficient information included in the 3D down-mix signal.

FIG. 12 is a block diagram of an encoding/decoding apparatus for processing an arbitrary down-mix signal according to an embodiment of the present invention. Referring to FIG. 12, an arbitrary down-mix signal is a down-mix signal other than a down-mix signal generated by a multi-channel encoder 801 included in an encoding apparatus 800. Detailed descriptions of the same processes as those of the embodiment of FIG. 1 will be omitted.

Referring to FIG. 12, the encoding apparatus 800 includes the multi-channel encoder 801, a spatial information synthesization unit 802, and a comparison unit 803.

The multi-channel encoder 801 down-mixes an input multi-channel signal into a stereo or mono down-mix signal, and generates basic spatial information necessary for restoring a multi-channel signal from the down-mix signal.

The comparison unit 803 compares the down-mix signal with an arbitrary down-mix signal, and generates compensation information based on the result of the comparison. The compensation information is necessary for compensating for the arbitrary down-mix signal so that the arbitrary down-mix signal can be converted to be approximate to the down-mix signal. A decoding apparatus may compensate for the arbitrary down-mix signal using the compensation information and restore a multi-channel signal using the compensated arbitrary down-mix signal. The restored multi-channel signal is more similar than a multi-channel signal restored from the arbitrary down-mix signal generated by the multi-channel encoder 801 to the original input multi-channel signal.

The compensation information may be a difference between the down-mix signal and the arbitrary down-mix signal. A decoding apparatus may compensate for the arbitrary down-mix signal by adding, to the arbitrary down-mix signal, the difference between the down-mix signal and the arbitrary down-mix signal.

The difference between the down-mix signal and the arbitrary down-mix signal may be down-mix gain which indicates the difference between the energy levels of the down-mix signal and the arbitrary down-mix signal.

The down-mix gain may be determined for each frequency band, for each time/time slot, and/or for each channel. For example, one part of the down-mix gain may be determined for each frequency band, and another part of the down-mix gain may be determined for each time slot.

The down-mix gain may be determined for each parameter band or for each frequency band optimized for the arbitrary down-mix signal. Parameter bands are frequency intervals to which parameter-type spatial information is applied.

The difference between the energy levels of the down-mix signal and the arbitrary down-mix signal may be quantized. The resolution of quantization levels for quantizing the difference between the energy levels of the down-mix signal and the arbitrary down-mix signal may be the same as or different from the resolution of quantization levels for quantizing a CLD between the down-mix signal and the arbitrary down-mix signal. In addition, the quantization of the difference between the energy levels of the down-mix signal and the arbitrary down-mix signal may involve the use of all or some of the quantization levels for quantizing the CLD between the down-mix signal and the arbitrary down-mix signal.

Since the resolution of the difference between the energy levels of the down-mix signal and the arbitrary down-mix signal is generally lower than the resolution of the CLD between the down-mix signal and the arbitrary down-mix signal, the resolution of the quantization levels for quantizing the difference between the energy levels of the down-mix signal and the arbitrary down-mix signal may have a minute value compared to the resolution of the quantization levels for quantizing the CLD between the down-mix signal and the arbitrary down-mix signal.

The compensation information for compensating for the arbitrary down-mix signal may be extension information including residual information which specifies components of the input multi-channel signal that cannot be restored using the arbitrary down-mix signal or the down-mix gain. A decoding apparatus can restore components of the input multi-channel signal that cannot be restored using the arbitrary down-mix signal or the down-mix gain using the extension information, thereby restoring a signal almost indistinguishable from the original input multi-channel signal.

Methods of generating the extension information are as follows.

The multi-channel encoder 801 may generate information regarding components of the input multi-channel signal that are lacked by the down-mix signal as first extension information. A decoding apparatus may restore a signal almost indistinguishable from the original input multi-channel signal by applying the first extension information to the generation of a multi-channel signal using the down-mix signal and the basic spatial information.

Alternatively, the multi-channel encoder 801 may restore a multi-channel signal using the down-mix signal and the basic spatial information, and generate the difference between the restored multi-channel signal and the original input multi-channel signal as the first extension information.

The comparison unit 803 may generate, as second extension information, information regarding components of the down-mix signal that are lacked by the arbitrary down-mix signal, i.e., components of the down-mix signal that cannot be compensated for using the down-mix gain. A decoding apparatus may restore a signal almost indistinguishable from the down-mix signal using the arbitrary down-mix signal and the second extension information.

The extension information may be generated using various residual coding methods other than the above-described method.

The down-mix gain and the extension information may both be used as compensation information. More specifically, the down-mix gain and the extension information may both be obtained for an entire frequency band of the down-mix signal and may be used together as compensation information. Alternatively, the down-mix gain may be used as compensation information for one part of the frequency band of the down-mix signal, and the extension information may be used as compensation information for another part of the frequency band of the down-mix signal. For example, the extension information may be used as compensation information for a low frequency band of the down-mix signal, and the down-mix gain may be used as compensation information for a high frequency band of the down-mix signal.

Extension information regarding portions of the down-mix signal, other than the low-frequency band of the down-mix signal, such as peaks or notches that may considerably affect the quality of sound may also be used as compensation information.

The spatial information synthesization unit 802 synthesizes the basic spatial information (e.g., a CLD, CPC, ICC, and CTD) and the compensation information, thereby generating spatial information. In other words, the spatial information, which is transmitted to a decoding apparatus, may include the basic spatial information, the down-mix gain, and the first and second extension information.

The spatial information may be included in a bitstream along with the arbitrary down-mix signal, and the bitstream may be transmitted to a decoding apparatus.

The extension information and the arbitrary down-mix signal may be encoded using an audio encoding method such as an AAC method, a MP3 method, or a BSAC method. The extension information and the arbitrary down-mix signal may be encoded using the same audio encoding method or different audio encoding methods.

If the extension information and the arbitrary down-mix signal are encoded using the same audio encoding method, a decoding apparatus may decode both the extension information and the arbitrary down-mix signal using a single audio decoding method. In this case, since the arbitrary down-mix signal can always be decoded, the extension information can also always be decoded. However, since the arbitrary down-mix signal is generally input to a decoding apparatus as a pulse code modulation (PCM) signal, the type of audio codec used to encode the arbitrary down-mix signal may not be readily identified, and thus, the type of audio codec used to encode the extension information may not also be readily identified.

Therefore, audio codec information regarding the type of audio codec used to encode the arbitrary down-mix signal and the extension information may be inserted into a bitstream.

More specifically, the audio codec information may be inserted into a specific configuration header field of a bitstream. In this case, a decoding apparatus may extract the audio codec information from the specific configuration header field of the bitstream and use the extracted audio codec information to decode the arbitrary down-mix signal and the extension information.

On the other hand, if the arbitrary down-mix signal and the extension information are encoded using different audio encoding methods, the extension information may not be able to be decoded. In this case, since the end of the extension information cannot be identified, no further decoding operation can be performed.

In order to address this problem, audio codec information regarding the types of audio codecs respectively used to encode the arbitrary down-mix signal and the extension information may be inserted into a specific configuration header field of a bitstream. Then, a decoding apparatus may read the audio codec information from the specific configuration header field of the bitstream and use the read information to decode the extension information. If the decoding apparatus does not include any decoding unit that can decode the extension information, the decoding of the extension information may not further proceed, and information next to the extension information may be read.

Audio codec information regarding the type of audio codec used to encode the extension information may be represented by a syntax element included in a specific configuration header field of a bitstream. For example, the audio codec information may be represented by bsResidualCodecType, which is a 4-bit syntax element, as indicated in Table 1 below.

TABLE 1

| bsResidualCodecType | Codec |
|---|---|
| 0 | AAC |
| 1 | MP3 |
| 2 | BSAC |
| 3 . . . 15 | Reserved |

The extension information may include not only the residual information but also channel expansion information. The channel expansion information is information necessary for expanding a multi-channel signal obtained through decoding using the spatial information into a multi-channel signal with more channels. For example, the channel expansion information may be information necessary for expanding a 5.1-channel signal or a 7.1-channel signal into a 9.1-channel signal.

The extension information may be included in a bitstream, and the bitstream may be transmitted to a decoding apparatus. Then, the decoding apparatus may compensate for the down-mix signal or expand a multi-channel signal using the extension information. However, the decoding apparatus may skip the extension information, instead of extracting the extension information from the bitstream. For example, in the case of generating a multi-channel signal using a 3D down-mix signal included in the bitstream or generating a 3D down-mix signal using a down-mix signal included in the bitstream, the decoding apparatus may skip the extension information.

A method of skipping the extension information included in a bitstream may be the same as one of the field skipping methods described above with reference to FIG. 10.

For example, the extension information may be skipped using at least one of bit size information which is attached to the beginning of a bitstream including the extension information and indicates the size in bits of the extension information, a syncword which is attached to the beginning or the end of the field including the extension information, and fixed bit size information which indicates a fixed size in bits of the extension information. The bit size information, the syncword, and the fixed bit size information may all be included in a bitstream. The fixed bit size information may also be stored in a decoding apparatus.

Referring to FIG. 12, a decoding unit 810 includes a down-mix compensation unit 811, a 3D rendering unit 815, and a multi-channel decoder 816.

The down-mix compensation unit 811 compensates for an arbitrary down-mix signal using compensation information included in spatial information, for example, using down-mix gain or extension information.

The 3D rendering unit 815 generates a decoder 3D down-mix signal by performing a 3D rendering operation on the compensated down-mix signal. The multi-channel decoder 816 generates a 3D multi-channel signal using the compensated down-mix signal and basic spatial information, which is included in the spatial information.

The down-mix compensation unit 811 may compensate for the arbitrary down-mix signal in the following manner.

If the compensation information is down-mix gain, the down-mix compensation unit 811 compensates for the energy level of the arbitrary down-mix signal using the down-mix gain so that the arbitrary down-mix signal can be converted into a signal similar to a down-mix signal.

If the compensation information is second extension information, the down-mix compensation unit 811 may compensate for components that are lacked by the arbitrary down-mix signal using the second extension information.

The multi-channel decoder 816 may generate a multi-channel signal by sequentially applying pre-matrix M1, mix-matrix M2 and post-matrix M3 to a down-mix signal. In this case, the second extension information may be used to compensate for the down-mix signal during the application of mix-matrix M2 to the down-mix signal. In other words, the second extension information may be used to compensate for a down-mix signal to which pre-matrix M1 has already been applied.

As described above, each of a plurality of channels may be selectively compensated for by applying the extension information to the generation of a multi-channel signal. For example, if the extension information is applied to a center channel of mix-matrix M2, left- and right-channel components of the down-mix signal may be compensated for by the extension information. If the extension information is applied to a left channel of mix-matrix M2, the left-channel component of the down-mix signal may be compensated for by the extension information.

The down-mix gain and the extension information may both be used as the compensation information. For example, a low frequency band of the arbitrary down-mix signal may be compensated for using the extension information, and a high frequency band of the arbitrary down-mix signal may be compensated for using the down-mix gain. In addition, portions of the arbitrary down-mix signal, other than the low frequency band of the arbitrary down-mix signal, for example, peaks or notches that may considerably affect the quality of sound, may also be compensated for using the extension information. Information regarding portion to be compensated for by the extension information may be included in a bitstream. Information indicating whether a down-mix signal included in a bitstream is an arbitrary down-mix signal or not and information indicating whether the bitstream includes compensation information may be included in the bitstream.

In order to prevent clipping of a down-mix signal generated by the encoding unit 800, the down-mix signal may be divided by predetermined gain. The predetermined gain may have a static value or a dynamic value.

The down-mix compensation unit 811 may restore the original down-mix signal by compensating for the down-mix signal, which is weakened in order to prevent clipping, using the predetermined gain.

An arbitrary down-mix signal compensated for by the down-mix compensation unit 811 can be readily reproduced. Alternatively, an arbitrary down-mix signal yet to be compensated for may be input to the 3D rendering unit 815, and may be converted into a decoder 3D down-mix signal by the 3D rendering unit 815.

Referring to FIG. 12, the down-mix compensation unit 811 includes a first domain converter 812, a compensation processor 813, and a second domain converter 814.

The first domain converter 812 converts the domain of an arbitrary down-mix signal into a predetermined domain. The compensation processor 813 compensates for the arbitrary down-mix signal in the predetermined domain, using compensation information, for example, down-mix gain or extension information.

The compensation of the arbitrary down-mix signal may be performed in a QMF/hybrid domain. For this, the first domain converter 812 may perform QMF/hybrid analysis on the arbitrary down-mix signal. The first domain converter 812 may convert the domain of the arbitrary down-mix signal into a domain, other than a QMF/hybrid domain, for example, a frequency domain such as a DFT or FFT domain. The compensation of the arbitrary down-mix signal may also be performed in a domain, other than a QMF/hybrid domain, for example, a frequency domain or a time domain.

The second domain converter 814 converts the domain of the compensated arbitrary down-mix signal into the same domain as the original arbitrary down-mix signal. More specifically, the second domain converter 814 converts the domain of the compensated arbitrary down-mix signal into the same domain as the original arbitrary down-mix signal by inversely performing a domain conversion operation performed by the first domain converter 812.

For example, the second domain converter 814 may convert the compensated arbitrary down-mix signal into a time-domain signal by performing QMF/hybrid synthesis on the compensated arbitrary down-mix signal. Also, the second domain converter 814 may perform IDFT or IFFT on the compensated arbitrary down-mix signal.

The 3D rendering unit 815, like the 3D rendering unit 710 illustrated in FIG. 7, may perform a 3D rendering operation on the compensated arbitrary down-mix signal in a frequency domain, a QMF/hybrid domain or a time domain. For this, the 3D rendering unit 815 may include a domain converter (not shown). The domain converter converts the domain of the compensated arbitrary down-mix signal into a domain in which a 3D rendering operation is to be performed or converts the domain of a signal obtained by the 3D rendering operation.

The domain in which the compensation processor 813 compensates for the arbitrary down-mix signal may be the same as or different from the domain in which the 3D rendering unit 815 performs a 3D rendering operation on the compensated arbitrary down-mix signal.

FIG. 13 is a block diagram of a down-mix compensation/3D rendering unit 820 according to an embodiment of the present invention. Referring to FIG. 13, the down-mix compensation/3D rendering unit 820 includes a first domain converter 821, a second domain converter 822, a compensation/3D rendering processor 823, and a third domain converter 824.

The down-mix compensation/3D rendering unit 820 may perform both a compensation operation and a 3D rendering operation on an arbitrary down-mix signal in a single domain, thereby reducing the amount of computation of a decoding apparatus.

More specifically, the first domain converter 821 converts the domain of the arbitrary down-mix signal into a first domain in which a compensation operation and a 3D rendering operation are to be performed. The second domain converter 822 converts spatial information, including basic spatial information necessary for generating a multi-channel signal and compensation information necessary for compensating for the arbitrary down-mix signal, so that the spatial information can become applicable in the first domain. The compensation information may include at least one of down-mix gain and extension information.

For example, the second domain converter 822 may map compensation information corresponding to a parameter band in a QMF/hybrid domain to a frequency band so that the compensation information can become readily applicable in a frequency domain.

The first domain may be a frequency domain such as a DFT or FFT domain, a QMF/hybrid domain, or a time domain. Alternatively, the first domain may be a domain other than those set forth herein.

During the conversion of the compensation information, a time delay may occur. In order to address this problem, the second domain converter 822 may perform a time delay compensation operation so that a time delay between the domain of the compensation information and the first domain can be compensated for.

The compensation/3D rendering processor 823 performs a compensation operation on the arbitrary down-mix signal in the first domain using the converted spatial information and then performs a 3D rendering operation on a signal obtained by the compensation operation. The compensation/3D rendering processor 823 may perform a compensation operation and a 3D rendering operation in a different order from that set forth herein.

The compensation/3D rendering processor 823 may perform a compensation operation and a 3D rendering operation on the arbitrary down-mix signal at the same time. For example, the compensation/3D rendering processor 823 may generate a compensated 3D down-mix signal by performing a 3D rendering operation on the arbitrary down-mix signal in the first domain using a new filter coefficient, which is the combination of the compensation information and an existing filter coefficient typically used in a 3D rendering operation.

The third domain converter 824 converts the domain of the 3D down-mix signal generated by the compensation/3D rendering processor 823 into a frequency domain.

FIG. 14 is a block diagram of a decoding apparatus 900 for processing a compatible down-mix signal according to an embodiment of the present invention. Referring to FIG. 14, the decoding apparatus 900 includes a first multi-channel decoder 910, a down-mix compatibility processing unit 920, a second multi-channel decoder 930, and a 3D rendering unit 940. Detailed descriptions of the same decoding processes as those of the embodiment of FIG. 1 will be omitted.

A compatible down-mix signal is a down-mix signal that can be decoded by two or more multi-channel decoders. In other words, a compatible down-mix signal is a down-mix signal that is initially optimized for a predetermined multi-channel decoder and that can be converted afterwards into a signal optimized for a multi-channel decoder, other than the predetermined multi-channel decoder, through a compatibility processing operation.

Referring to FIG. 14, assume that an input compatible down-mix signal is optimized for the first multi-channel decoder 910. In order for the second multi-channel decoder 930 to decode the input compatible down-mix signal, the down-mix compatibility processing unit 920 may perform a compatibility processing operation on the input compatible down-mix signal so that the input compatible down-mix signal can be converted into a signal optimized for the second multi-channel decoder 930. The first multi-channel decoder 910 generates a first multi-channel signal by decoding the input compatible down-mix signal. The first multi-channel decoder 910 can generate a multi-channel signal through decoding simply using the input compatible down-mix signal without a requirement of spatial information.

The second multi-channel decoder 930 generates a second multi-channel signal using a down-mix signal obtained by the compatibility processing operation performed by the down-mix compatibility processing unit 920. The 3D rendering unit 940 may generate a decoder 3D down-mix signal by performing a 3D rendering operation on the down-mix signal obtained by the compatibility processing operation performed by the down-mix compatibility processing unit 920.

A compatible down-mix signal optimized for a predetermined multi-channel decoder may be converted into a down-mix signal optimized for a multi-channel decoder, other than the predetermined multi-channel decoder, using compatibility information such as an inversion matrix. For example, when there are first and second multi-channel encoders using different encoding methods and first and second multi-channel decoders using different encoding/decoding methods, an encoding apparatus may apply a matrix to a down-mix signal generated by the first multi-channel encoder, thereby generating a compatible down-mix signal which is optimized for the second multi-channel decoder. Then, a decoding apparatus may apply an inversion matrix to the compatible down-mix signal generated by the encoding apparatus, thereby generating a compatible down-mix signal which is optimized for the first multi-channel decoder.

Referring to FIG. 14, the down-mix compatibility processing unit 920 may perform a compatibility processing operation on the input compatible down-mix signal using an inversion matrix, thereby generating a down-mix signal which is optimized for the second multi-channel decoder 930.

Information regarding the inversion matrix used by the down-mix compatibility processing unit 920 may be stored in the decoding apparatus 900 in advance or may be included in an input bitstream transmitted by an encoding apparatus. In addition, information indicating whether a down-mix signal included in the input bitstream is an arbitrary down-mix signal or a compatible down-mix signal may be included in the input bitstream.

Referring to FIG. 14, the down-mix compatibility processing unit 920 includes a first domain converter 921, a compatibility processor 922, and a second domain converter 923.

The first domain converter 921 converts the domain of the input compatible down-mix signal into a predetermined domain, and the compatibility processor 922 performs a compatibility processing operation using compatibility information such as an inversion matrix so that the input compatible down-mix signal in the predetermined domain can be converted into a signal optimized for the second multi-channel decoder 930.

The compatibility processor 922 may perform a compatibility processing operation in a QMF/hybrid domain. For this, the first domain converter 921 may perform QMF/hybrid analysis on the input compatible down-mix signal. Also, the first domain converter 921 may convert the domain of the input compatible down-mix signal into a domain, other than a QMF/hybrid domain, for example, a frequency domain such as a DFT or FFT domain, and the compatibility processor 922 may perform the compatibility processing operation in a domain, other than a QMF/hybrid domain, for example, a frequency domain or a time domain.

The second domain converter 923 converts the domain of a compatible down-mix signal obtained by the compatibility processing operation. More specifically, the second domain converter 923 may convert the domain of the compatibility down-mix signal obtained by the compatibility processing operation into the same domain as the original input compatible down-mix signal by inversely performing a domain conversion operation performed by the first domain converter 921.

For example, the second domain converter 923 may convert the compatible down-mix signal obtained by the compatibility processing operation into a time-domain signal by performing QMF/hybrid synthesis on the compatible down-mix signal obtained by the compatibility processing operation. Alternatively, the second domain converter 923 may perform IDFT or IFFT on the compatible down-mix signal obtained by the compatibility processing operation.

The 3D rendering unit 940 may perform a 3D rendering operation on the compatible down-mix signal obtained by the compatibility processing operation in a frequency domain, a QMF/hybrid domain or a time domain. For this, the 3D rendering unit 940 may include a domain converter (not shown). The domain converter converts the domain of the input compatible down-mix signal into a domain in which a 3D rendering operation is to be performed or converts the domain of a signal obtained by the 3D rendering operation.

The domain in which the compatibility processor 922 performs a compatibility processing operation may be the same as or different from the domain in which the 3D rendering unit 940 performs a 3D rendering operation.

FIG. 15 is a block diagram of a down-mix compatibility processing/3D rendering unit 950 according to an embodiment of the present invention. Referring to FIG. 15, the down-mix compatibility processing/3D rendering unit 950 includes a first domain converter 951, a second domain converter 952, a compatibility/3D rendering processor 953, and a third domain converter 954.

The down-mix compatibility processing/3D rendering unit 950 performs a compatibility processing operation and a 3D rendering operation in a single domain, thereby reducing the amount of computation of a decoding apparatus.

The first domain converter 951 converts an input compatible down-mix signal into a first domain in which a compatibility processing operation and a 3D rendering operation are to be performed. The second domain converter 952 converts spatial information and compatibility information, for example, an inversion matrix, so that the spatial information and the compatibility information can become applicable in the first domain.

For example, the second domain converter 952 maps an inversion matrix corresponding to a parameter band in a QMF/hybrid domain to a frequency domain so that the inversion matrix can become readily applicable in a frequency domain.

The first domain may be a frequency domain such as a DFT or FFT domain, a QMF/hybrid domain, or a time domain. Alternatively, the first domain may be a domain other than those set forth herein.

During the conversion of the spatial information and the compatibility information, a time delay may occur. In order to address this problem, In order to address this problem, the second domain converter 952 may perform a time delay compensation operation so that a time delay between the domain of the spatial information and the compensation information and the first domain can be compensated for.

The compatibility/3D rendering processor 953 performs a compatibility processing operation on the input compatible down-mix signal in the first domain using the converted compatibility information and then performs a 3D rendering operation on a compatible down-mix signal obtained by the compatibility processing operation. The compatibility/3D rendering processor 953 may perform a compatibility processing operation and a 3D rendering operation in a different order from that set forth herein.

The compatibility/3D rendering processor 953 may perform a compatibility processing operation and a 3D rendering operation on the input compatible down-mix signal at the same time. For example, the compatibility/3D rendering processor 953 may generate a 3D down-mix signal by performing a 3D rendering operation on the input compatible down-mix signal in the first domain using a new filter coefficient, which is the combination of the compatibility information and an existing filter coefficient typically used in a 3D rendering operation.

The third domain converter 954 converts the domain of the 3D down-mix signal generated by the compatibility/3D rendering processor 953 into a frequency domain.

FIG. 16 is a block diagram of a decoding apparatus for canceling crosstalk according to an embodiment of the present invention. Referring to FIG. 16, the decoding apparatus includes a bit unpacking unit 960, a down-mix decoder 970, a 3D rendering unit 980, and a crosstalk cancellation unit 990. Detailed descriptions of the same decoding processes as those of the embodiment of FIG. 1 will be omitted.

A 3D down-mix signal output by the 3D rendering unit 980 may be reproduced by a headphone. However, when the 3D down-mix signal is reproduced by speakers that are distant apart from a user, inter-channel crosstalk is likely to occur.

Therefore, the decoding apparatus may include the crosstalk cancellation unit 990 which performs a crosstalk cancellation operation on the 3D down-mix signal.

The decoding apparatus may perform a sound field processing operation.

Sound field information used in the sound field processing operation, i.e., information identifying a space in which the 3D down-mix signal is to be reproduced, may be included in an input bitstream transmitted by an encoding apparatus or may be selected by the decoding apparatus.

The input bitstream may include reverberation time information. A filter used in the sound field processing operation may be controlled according to the reverberation time information.

A sound field processing operation may be performed differently for an early part and a late reverberation part. For example, the early part may be processed using a FIR filter, and the late reverberation part may be processed using an IIR filter.

More specifically, a sound field processing operation may be performed on the early part by performing a convolution operation in a time domain using an FIR filter or by performing a multiplication operation in a frequency domain and converting the result of the multiplication operation to a time domain. A sound field processing operation may be performed on the late reverberation part in a time domain.

The present invention can be realized as computer-readable code written on a computer-readable recording medium. The computer-readable recording medium may be any type of recording device in which data is stored in a computer-readable manner. Examples of the computer-readable recording medium include a ROM, a RAM, a CD-ROM, a magnetic tape, a floppy disc, an optical data storage, and a carrier wave (e.g., data transmission through the Internet). The computer-readable recording medium can be distributed over a plurality of computer systems connected to a network so that computer-readable code is written thereto and executed therefrom in a decentralized manner. Functional programs, code, and code segments needed for realizing the present invention can be easily construed by one of ordinary skill in the art.

As described above, according to the present invention, it is possible to efficiently encode multi-channel signals with 3D effects and to adaptively restore and reproduce audio signals with optimum sound quality according to the characteristics of a reproduction environment.

INDUSTRIAL APPLICABILITY

Other implementations are within the scope of the following claims. For example, grouping, data coding, and entropy coding according to the present invention can be applied to various application fields and various products. Storage media storing data to which an aspect of the present invention is applied are within the scope of the present invention.

The invention claimed is:

1. A method of decoding a signal, comprising:

receiving a three-dimensional (3D) down-mix signal and spatial information;

removing 3D effect from the 3D down-mix signal by performing a 3D rendering operation on the 3D down-mix signal; and generating a multi-channel signal using the spatial information and a down-mix signal which the 3D effect is removed from, wherein the removing the 3D effect is performed using an inverse function of a function used for generating the 3D down-mix signal, and wherein the inverse function is derived from head related transfer function (HRTF) used for generating the 3D down-mix signal.

2. The method of claim 1, wherein the removing the 3D effect is performed using an inverse filter of a filter used for generating the 3D down-mix signal.

3. The method of claim 2, wherein an information regarding the filter is extracted from an input bitstream.

4. The method of claim 1, wherein at least one of an information regarding coefficients of the HRTF and an information regarding coefficients of the inverse function of the HRTF is extracted from an input bitstream.

5. The method of claim 1, further comprising receiving at least one of an information indicating whether an input bitstream includes an information regarding a filter used for generating the 3D down-mix signal and an information indicating whether an input bitstream includes an information regarding an inverse filter of the filter.

6. The method of claim 1, wherein the 3D rendering operation is performed in one of a discrete Fourier transform (DFT) domain, a fast Fourier transform (FFT) domain, a quadrature mirror filter (QMF)/hybrid domain, and a time domain.

7. A non-transitory computer-readable recording medium having a computer program for executing the decoding method of claim 1.

8. An apparatus for decoding a signal, comprising:

a bit unpacking unit receiving a 3D down-mix signal and spatial information;

a 3D rendering unit removing 3D effect from the 3D down-mix signal by performing a 3D rendering operation on the 3D down-mix signal; and a multi-channel decoder generating a multi-channel signal using the spatial information and a down-mix signal which the 3D effect is removed from, wherein the removing the 3D effect is performed using an inverse function of a function used for generating the 3D down-mix signal, and wherein the inverse function is derived from head related transfer function (HRTF) used for generating the 3D down-mix signal.

9. The apparatus of claim 8, wherein the 3D rendering unit removes the 3D effect from the 3D down-mix signal using an inverse filter of a filter used for generating the 3D down-mix signal.

10. The apparatus of claim 9, wherein an information regarding the filter is extracted from an input bitstream.

11. The decoding apparatus of claim 8, wherein at least one of an information regarding coefficients of the HRTF and an information regarding coefficients of the inverse function of the HRTF is extracted from an input bitstream.

12. The decoding apparatus of claim 8, wherein the bit unpacking unit receives at least one of an information indicating whether an input bitstream includes an information regarding a filter used for generating the 3D down-mix signal and an information indicating whether an input bitstream includes an information regarding an inverse filter of the filter.

13. The decoding apparatus of claim 8, wherein the 3D rendering operation is performed in one of a discrete Fourier transform (DFT) domain, a fast Fourier transform (FFT) domain, a quadrature mirror filter (QMF)/hybrid domain, and a time domain.

* * * * *